US005975795A

United States Patent [19]

Green

[11] Patent Number: 5,975,795

[45] Date of Patent: Nov. 2, 1999

[54] SYSTEM FOR INSTALLING RAISED ROAD MARKERS

[75] Inventor: John L. Green, Sedro Woolley, Wash.

[73] Assignee: Accrued, Inc., Olympia, Wash.

[21] Appl. No.: 09/193,227

[22] Filed: Nov. 17, 1998

Related U.S. Application Data

[62] Division of application No. 08/698,427, Aug. 15, 1996, Pat. No. 5,853,263.

[51] Int. Cl.[6] ..... E01C 23/18

[52] U.S. Cl. ..... 404/94; 221/289

[58] Field of Search ..... 404/93, 94, 73; 221/185, 289

[56] References Cited

U.S. PATENT DOCUMENTS

| | | | |
|---|---|---|---|
| 3,590,701 | 7/1971 | Broeck | 404/84.05 |
| 4,936,485 | 6/1990 | Downing | 221/297 |
| 4,974,990 | 12/1990 | Anderson et al. | 404/94 |
| 5,244,334 | 9/1993 | Akita et al. . | |
| 5,853,263 | 12/1998 | Green | 404/94 |

*Primary Examiner*—James A. Lisehora
*Attorney, Agent, or Firm*—Joan H. Pauly

[57] ABSTRACT

An installation head is mounted on a vehicle and moves along and adjacent to a roadway as the vehicle moves along the roadway. The head has a loading station at the bottom of a vertical loading chamber and a slide that slides along a floor to move markers out of the loading station into a setting station. A setting ram forces markers down onto adhesive prepositioned on the roadway. A plurality of heads may be positioned on the vehicle and may form opposite rows for simultaneously installing markers on opposite sides of a traffic lane. An indexed marker that interlocks with adjacent markers to prevent tilting may be used to maximize the reliability of the system. Various types of delivery devices may be used to deliver markers to the loading station. These include a delivery platform or carrousel positioned above the loading chamber to deliver markers down into the loading chamber. They also include a collating tape that delivers markers into the loading chamber through a side opening.

7 Claims, 13 Drawing Sheets

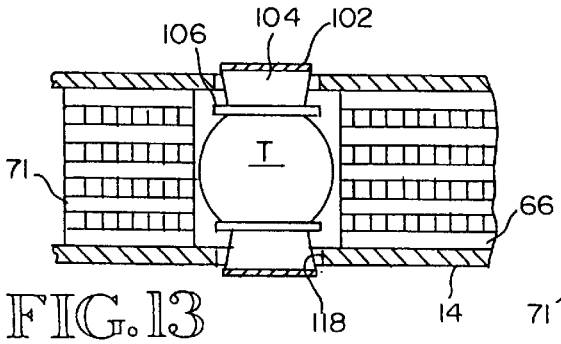
FIG. 13
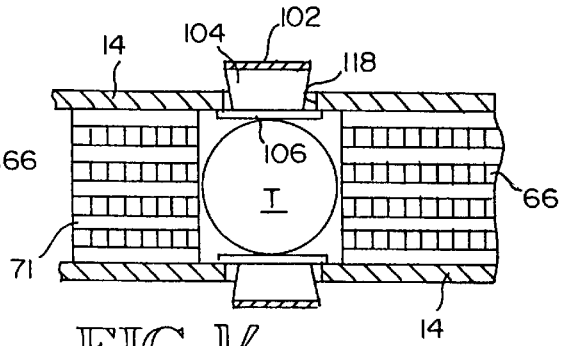
FIG. 14
FIG. 16
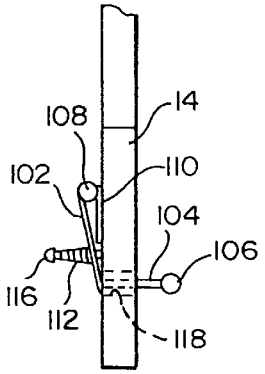
FIG. 15
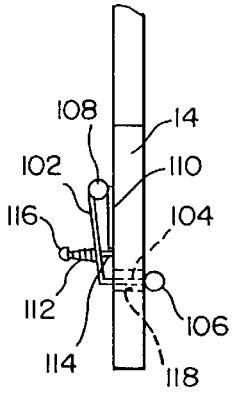
FIG. 17
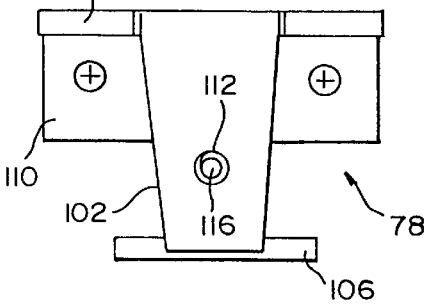
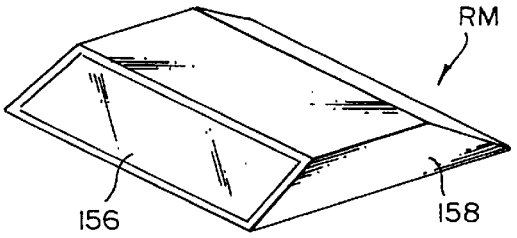
FIG. 22
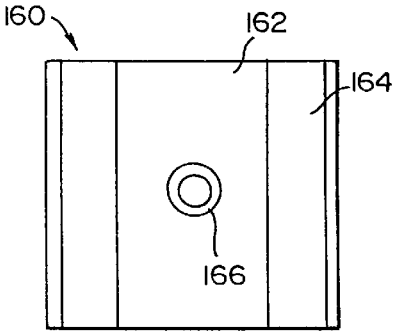
FIG. 24
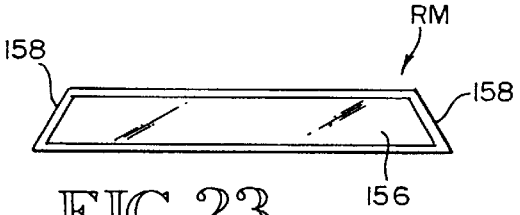
FIG. 23
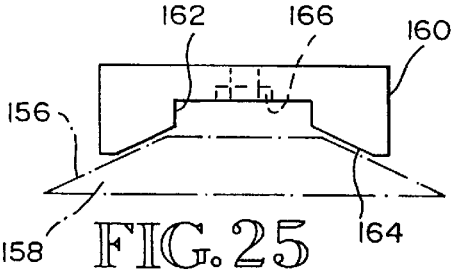
FIG. 25

FIG. 18
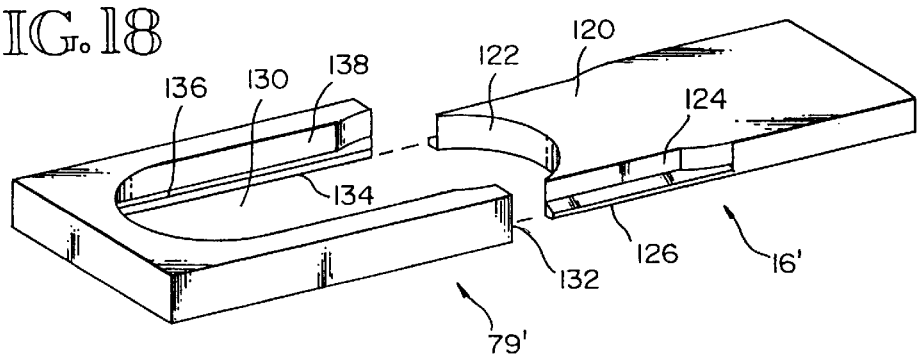
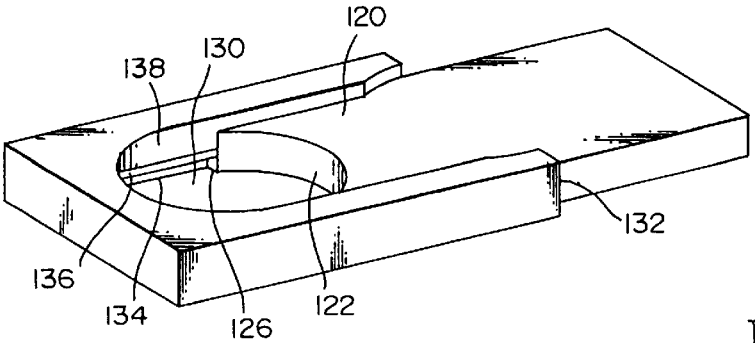
FIG. 19
FIG. 21
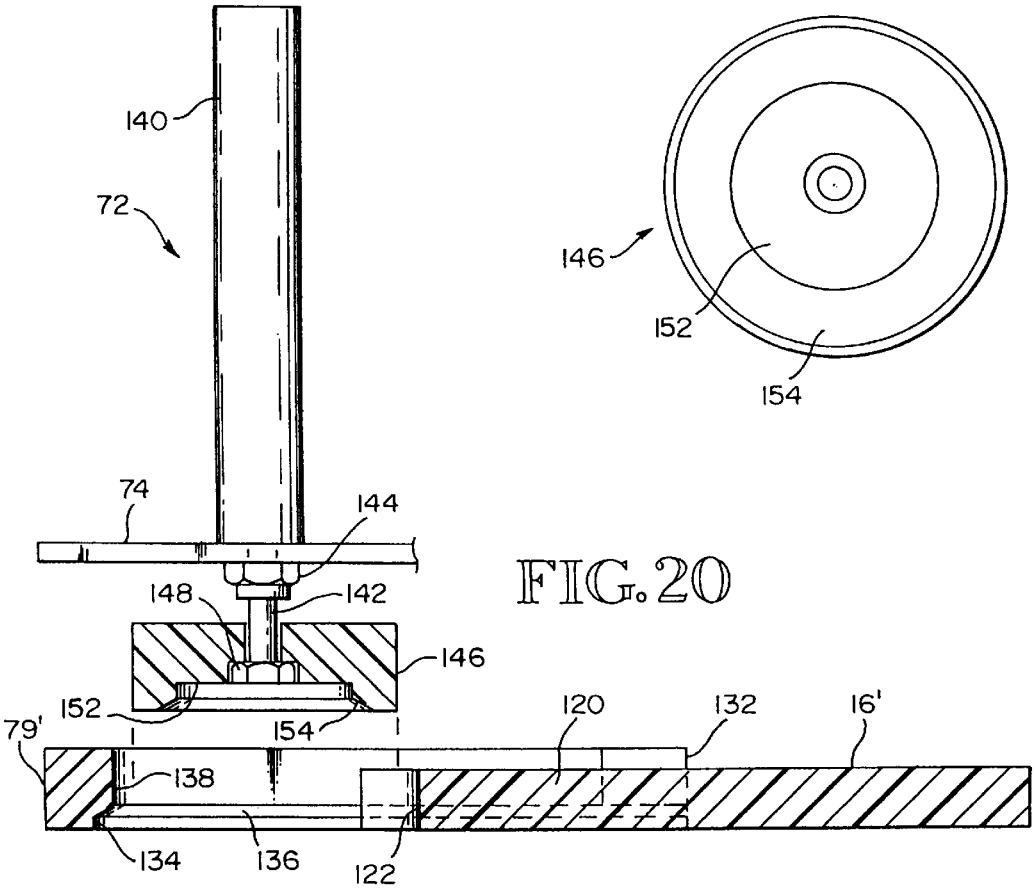
FIG. 20

FIG. 34
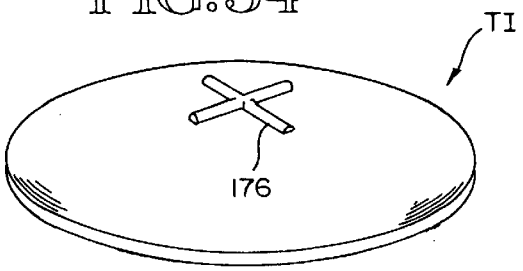
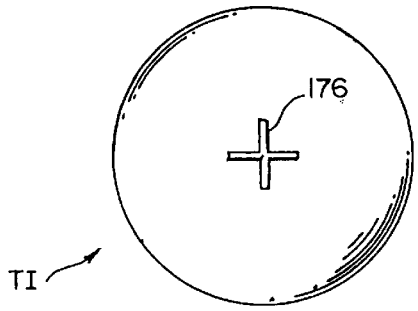
FIG. 35A
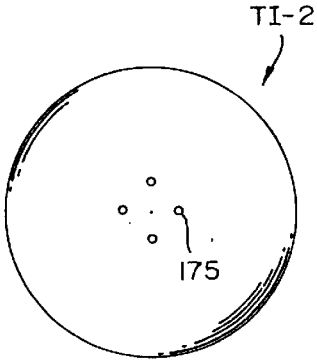
FIG. 36A
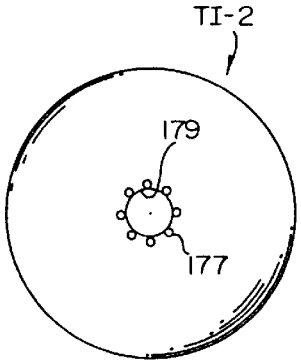
FIG. 36B
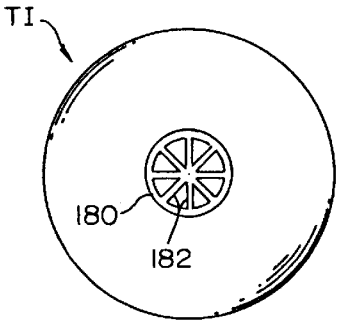
FIG. 35B
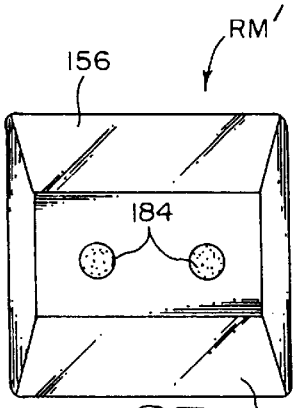
FIG. 37
FIG. 38
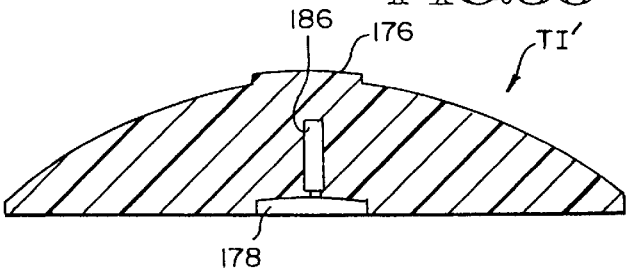
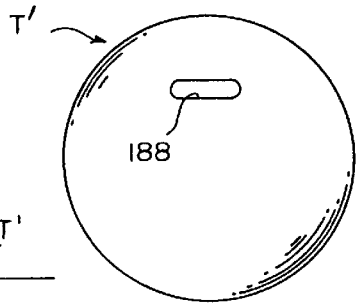
FIG. 40
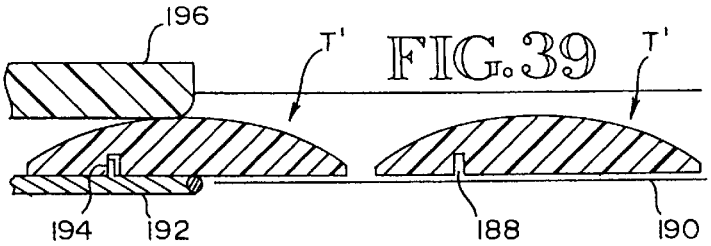
FIG. 39

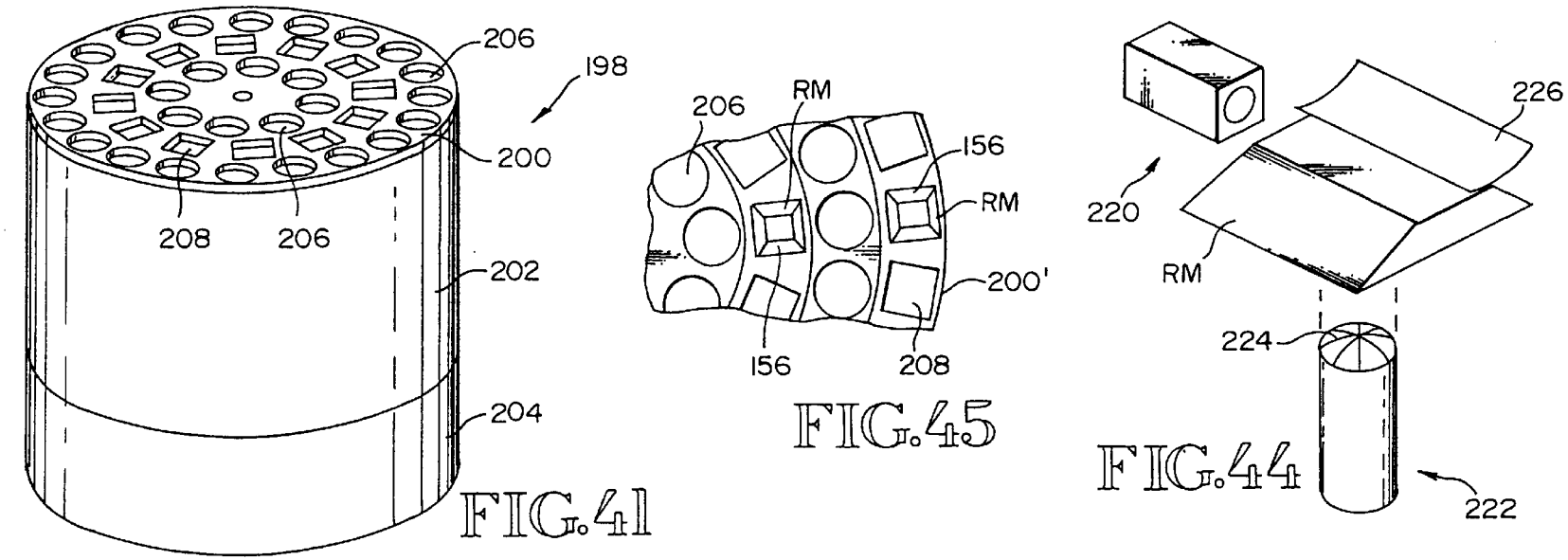
FIG. 44
FIG. 45
FIG. 41
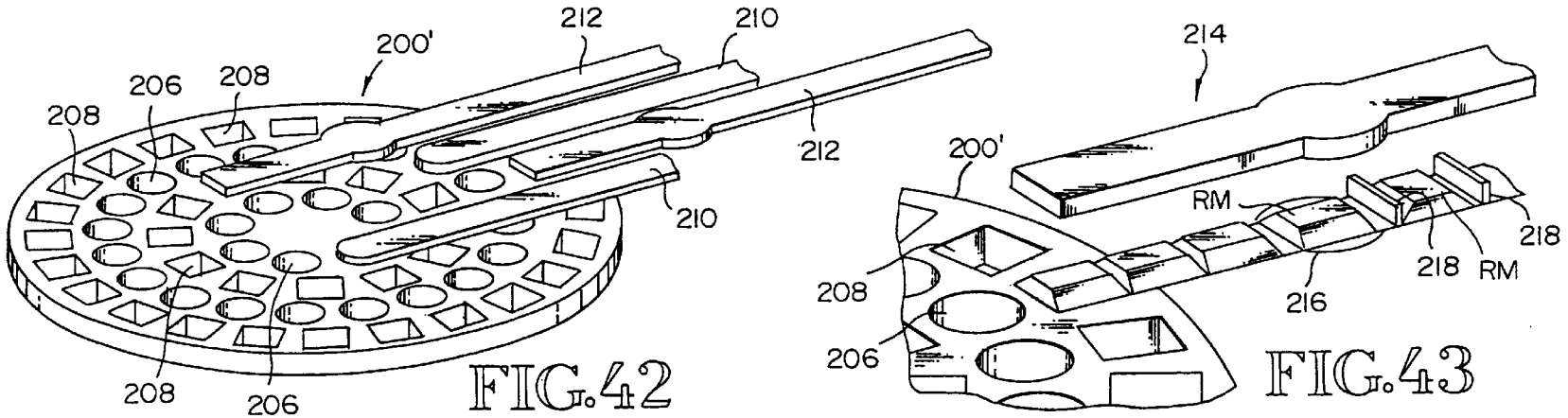
FIG. 43
FIG. 42

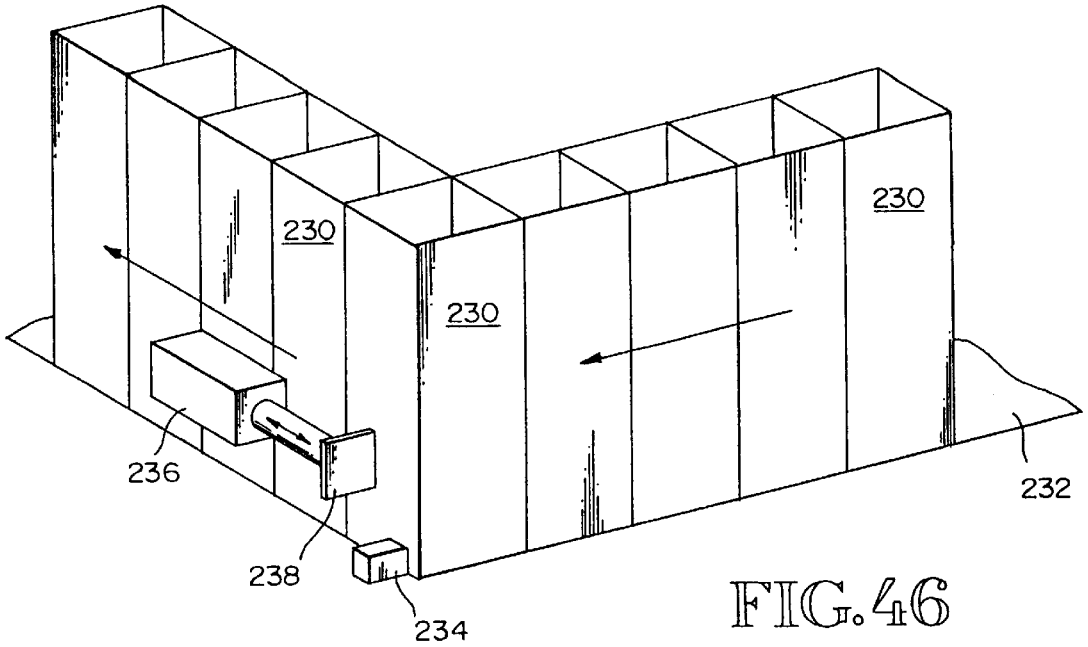
FIG. 46
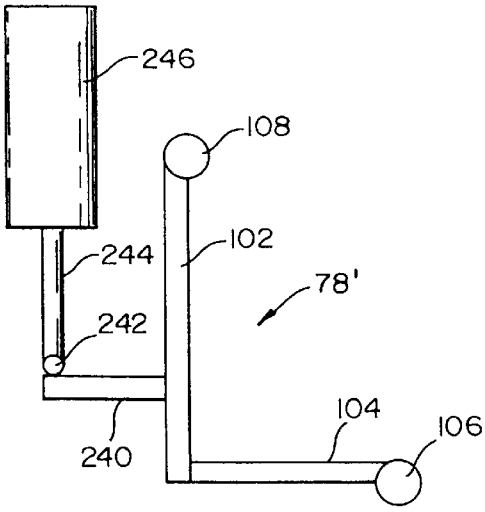
FIG. 47
FIG. 48
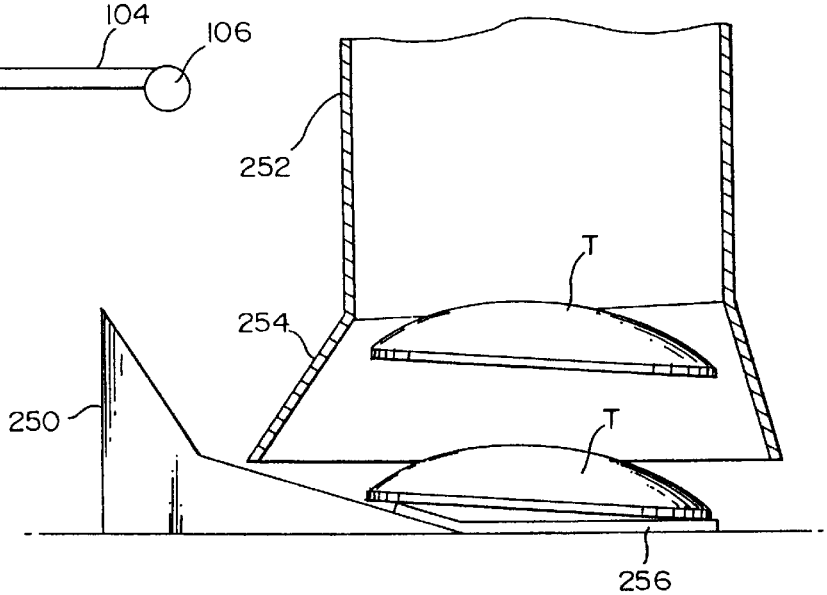

SYSTEM FOR INSTALLING RAISED ROAD MARKERS

RELATED APPLICATION

This application is a division of U.S. patent application Ser. No. 08/698,427, filed Aug. 15, 1996, U.S. Pat. No. 5,853,263

TECHNICAL FIELD

This invention relates to apparatus for automated installation of raised road markers and to specialized markers for use in automated installation systems. More particularly, the invention relates to an installation head having a slide that moves markers along a floor from a loading station at the bottom of a loading chamber to a setting station to be set down onto a roadway by a ram, an indexed marker that interlocks with adjacent markers to prevent tilting, a delivery platform on which bottomless containers are sequentially moved into a supply station to discharge stacks of markers, and a three-tier carrousel for stacking markers and discharging stacks of markers.

BACKGROUND INFORMATION

The systems currently in use for installing raised road markers on a roadway have a number of serious drawbacks. These drawbacks include high labor requirements and thus high labor costs, slow speed of installation and consequent low productivity, and especially worker safety concerns. One of the primary sources of concerns for worker safety is the necessity of having a worker stationed in a position relatively exposed to traffic. The installation procedures currently in use are not automated or are incompletely automated. Therefore, a worker is commonly placed in a position adjacent to the roadway to permit the worker to manually place adhesive and/or markers onto the roadway. If, as commonly is the case, the roadway is not closed to traffic, traffic passes in close proximity to the worker. When hot melt adhesives are used, the worker is also subjected to the hazard of handling high temperature materials. In addition, the lack of automation is not conducive to accurate installation of markers because of the vulnerability of the procedures to human error.

SUMMARY OF THE INVENTION

A subject of the invention is apparatus for installing raised road markers on a roadway. According to an aspect of the invention, the apparatus comprises an installation head mountable on a vehicle in a position to be moved along and adjacent to the roadway. The head includes an at least substantially horizontal floor with an upper surface and a loading station located on the upper surface. A setting station is spaced from the loading station along the floor. A slide has a vertical thickness substantially equal to the height of the markers. An actuator is operatively connected to the slide to move the slide back and forth along the upper surface of the floor. Walls define an at least substantially vertical loading chamber above the loading station. The walls include first and second opposite portions, each of which is spaced above the floor a distance sufficient to allow a single marker to move out of the loading station along the floor and under the portion. The distance is insufficient to allow more than one marker to move under the portion at the same time. The slide has an abutment surface for pushing a marker out of the loading station and into the setting station when the slide is moved along the floor. A ram has a retracted position above the setting station and is extendible toward the setting station to force a marker in the setting station down onto the roadway.

In a particular application of the apparatus of the invention, one or a plurality of installation heads may be used. In new construction, a preferable arrangement is a plurality of heads positioned on a vehicle in opposite rows spaced apart laterally. This enables simultaneous installing of markers on opposite sides of a traffic lane.

In the currently contemplated embodiments, the installation head has an opening for receiving markers into the loading chamber. This opening may be perpendicular to the opposite portions of the walls and adjacent to the loading station. In such case, the apparatus may further comprise a collation tape that carries markers to the opening. The collation tape may be actuated in various ways. Preferably, the apparatus includes a drive roller around which the collation tape extends adjacent to the loading station. A rack gear is carried by the slide. A pinion gear engages the rack gear and is operatively connected to the drive roller to transmit sliding movement of the slide along the floor into rotational movement of the drive roller. The rotational movement of the drive roller moves an upper run of the collation tape toward the loading station.

The opening may also be a top opening into the loading chamber. In this case, the loading chamber is preferably dimensioned to hold a stack of markers. Various types of delivery devices may be used for feeding markers into the loading chamber down through the top opening.

One type of delivery device is a delivery platform positioned above the loading chamber and having a supply station, a delivery opening at the supply station communicating with the top opening, and a supply pathway leading to the supply station. Each of a plurality of bottomless containers is dimensioned to receive a stack of markers and has a sensing aperture in a lower portion thereof. A sensor is positioned adjacent to the supply station to sense through the aperture when a container in the supply station is empty of markers. A removal actuator is engageable with a container in the supply station to move the container out of the supply station and allow another container to move along the supply pathway into the supply station.

The delivery platform and the apparatus associated therewith may take various forms. In one such form, the removal actuator comprises an engagement wheel powered to rotate about a vertical axis. The wheel has a plurality of circumferentially spaced cutouts configured to engage circumferential surfaces of the containers. In another form, the containers are rectangular, and the removal actuator comprises a ram. The ram is extendible and retractable perpendicularly to the supply pathway to pull a container in the supply station out of the supply station in a direction perpendicular to the supply pathway.

Another type of delivery device is a multi-tiered carrousel positioned above the loading chamber to feed markers down into the loading chamber through the top opening. The carrousel comprises three concentric tiers. Each tier has a plurality of vertical openings to receive markers. The tiers include a rotatable top tier having a height substantially equal to the height of a single marker, a stationary middle tier, and a rotatable lower tier. Each of the middle and lower tiers has a height sufficient to accommodate a stack of markers in each vertical opening therein. The vertical openings in each tier are alignable with the vertical openings in an adjacent tier.

A preferred feature of the carrousel is an arrangement for automatically orienting square reflective markers. In this arrangement, the vertical openings in the top tier include a plurality of square openings arranged in a circle. A guideway leads to the circle. An orienting station is located along the guideway. A sensor is positioned adjacent to the orienting station and is adapted to sense the presence of an adjacent reflective surface. A pivot device is positioned to be moved into engagement with a square marker in the orienting station and to pivot the square marker until a reflective surface thereof is facing the sensor.

The apparatus may also be provided with one or more additional preferred features. One such feature is a slide and floor stop member configured for use with round markers. The stop member has an arcuate surface adjacent to the setting station. The slide has an arcuate end surface for engaging a round marker. The slide is movable into a position in which a round marker in the setting station is held between the arcuate surfaces to prevent tilting of the marker. Another preferred feature is a ram that has a head with a downwardly directed recess configured to receive a top portion of a marker. The ram head may be configured to engage either round markers with domed upper surfaces or rectangular markers with upper flat surfaces. In either case, the configuration of the ram head helps stabilize the marker as it is forced downward onto the roadway.

In the preferred embodiment of the installation head, the head includes two setting stations spaced apart along the floor. The slide has an opening therethrough defining a movable second loading station alignable with one of the setting stations. Another feature that is currently preferred for use in a head with two setting stations is a stop dog for limiting retracting movement of the slide. The slide's movement away from an outer one of the setting stations is limited to prevent delivery of more than one marker to the outer one of the setting stations.

Another feature of the invention designed primarily for use in repair operations of existing roadways is apparatus to remove old markers. The apparatus includes a scraper mountable on the vehicle forward of the installation head to free an old marker from the roadway. A vacuum tube is positioned to remove the freed marker and associated debris.

Another subject of the invention is an indexed raised road marker. The marker comprises a body having a rounded top surface and a flat bottom surface. An indexing projection extends upwardly from the top surface. A complementary recess extends into the bottom surface to receive the projection on an adjacent marker to interlock the markers. The interlocking of the markers prevents tilting of the markers. The projection and the recess are configured to allow adjacent markers to interlock in a plurality of relative circumferential orientations.

The configurations of the indexing projection and complementary recess may be varied. In a first preferred form, the projection has a plurality of equally circumferentially spaced arms. The recess has a plurality of equally circumferentially spaced spokes, at least two spokes for each arm. In a second preferred form, the projection comprises a plurality of equally circumferentially spaced raised dimples, and the recess comprises a plurality of equally circumferentially spaced circular depressions, at least two depressions for each dimple.

Still another subject of the invention is a raised road marker comprising a molded plastic body having an internal cavity configured to receive an electronic component.

Additional aspects of the apparatus for installing raised road markers include the type of delivery platform described above, and the carrousel described above.

The apparatus and marker of the invention have a number of advantages. The apparatus is designed for a fully automated, relatively high speed installation procedure. The installation of markers can be accomplished using as few as two workers, both of whom may be isolated from traffic hazards throughout the procedure. Thus, labor costs are greatly decreased and, at the same time, worker safety is maximized. Overall productivity of the installation of markers is maximized and traffic disruption is held to a minimum. Further savings in equipment acquisition and maintenance are achieved by the simplicity of structure of the various aspects of the apparatus. The apparatus also is efficient and reliable in operation, lays down road markers with a high level of accuracy, and has flexibility to meet the differing requirements of various situations.

BRIEF DESCRIPTION OF THE DRAWINGS

In the drawings, like element designations refer to like parts throughout, and:

FIG. 13 is a fragmentary bottom plan view of a portion of the preferred embodiment of the installation head floor illustrating a road marker supported by the bomb bay doors ready to be set down onto pavement by the setting ram.

FIG. 14 is like FIG. 13 except that it shows the marker as it is being moved downwardly and is forcing the bomb bay doors open.

FIG. 15 is a fragmentary side elevational view of one of the installation head sidewalls and a bomb bay door mounted thereon, showing the bomb bay door in the position shown in FIG. 13.

FIG. 16 is like FIG. 15 except that it shows the bomb bay door in the open position shown in FIG. 14.

FIG. 17 is an elevational view of the preferred embodiment of the bomb bay door shown in FIGS. 13–16.

FIG. 18 is a pictorial view of a modified form of the slide designed for use with round road markers and an end stop member, showing the end of the floor and the stop member in a separated position.

FIG. 19 is like FIG. 18 except that it shows the slide and stop members in an interengaged position.

FIG. 20 is a sectional view of the apparatus shown in FIGS. 18 and 19 and the associated setting ram, with parts shown in elevation.

FIG. 21 is a bottom plan view of the setting ram head shown in FIG. 20.

FIG. 22 is a pictorial view of a rectangular reflector type road marker.

FIG. 23 is an elevational view of the marker shown in FIG. 22, directed toward the major reflective face of the marker.

FIG. 24 is a bottom plan view of a setting ram head designed for use with the type of marker shown in FIGS. 22 and 23.

FIG. 25 is an elevational view of the ram head shown in FIG. 24 engaging a road marker, shown in phantom.

FIG. 34 is a pictorial view of a modifying round marker with indexing portions.

FIG. 35A is a top plan view of the marker shown in FIG. 34.

FIG. 35B is a bottom plan view of the marker shown in FIG. 34.

FIGS. 36A and 36B are like FIGS. 35A and 35B except that they show another embodiment of the indexed marker.

FIG. 37 is a top plan view of a modified form of a reflective square marker.

FIG. 38 is a sectional view of a modification of the marker shown in FIGS. 34–36.

FIG. 39 is a partially schematic sectional view of still another modification of a round road marker and an associated feeding and indexing mechanism.

FIG. 40 is a bottom plan view of the marker shown in FIG. 39.

FIG. 41 is a pictorial view of a three-tier carrousel.

FIG. 42 is a pictorial view of a modified form of the upper tier of the three-tier carrousel shown in FIG. 41 and associated marker guideways.

FIG. 43 is a fragmentary pictorial view of a portion of FIG. 42 showing one of the guideways with its cover removed.

FIG. 44 is an exploded pictorial view of the orientating apparatus of the guideways shown in FIG. 43 and a marker positioned in the orienting station.

FIG. 45 is a fragmentary plan view illustrating the resulting orientations of markers in two separate circles of square openings.

FIG. 46 is a pictorial view of another form feeding mechanism for feeding stacks of markers into position for the markers to be fed down into an installation head.

FIG. 47 is a simplified elevational view of an alternate embodiment of the bomb bay door and the biasing mechanism therefor.

FIG. 48 is an elevational view, with parts shown in section, of apparatus for removing old turtles from pavement.

BEST MODES FOR CARRYING OUT THE INVENTION

The drawings show apparatus for installing raised road markers on a roadway and specialized markers that may be installed using the apparatus. The illustrated apparatus and markers are constructed according to the invention and also constitute the best modes for carrying out the invention currently known to the applicant. The apparatus shown in FIGS. 1 and 2 includes more than one means for delivering road markers to the installation head H. In a particular use of the apparatus of the invention, the apparatus may include alternate delivery means, as illustrated. However, it is currently anticipated that most individual installations will include only one delivery means.

Figure 1:
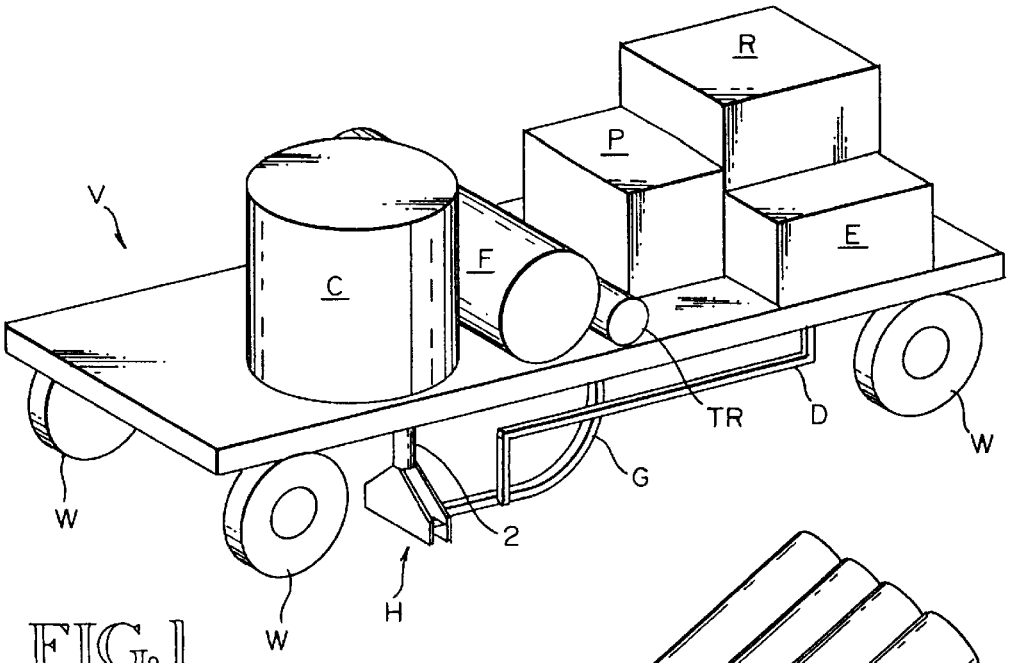
FIG. 1 is a schematic pictorial view of a trailer portion of a vehicle on which elements of the preferred embodiments of the invention are mounted.

FIG. 1 shows the trailer portion V of a vehicle having a bed mounted on wheels W to permit the trailer V to be pulled by a cab portion of the vehicle (not shown). Elements of the apparatus of the invention are mounted on and under the trailer bed. These elements include an adhesive reservoir R and a dispenser or glue tube D. They also include an air compressor P and an electrical unit E for powering the other elements. It is anticipated that the apparatus of the invention will be used to install road markers using a hot melt bitumen adhesive. In such case, the reservoir R would be provided with heating means powered by the electrical unit E to maintain the bitumen adhesive at the correct installation temperature. Alternatively, the apparatus of the invention could be used in connection with a two-part adhesive, such as the adhesive sold under the trademark "EPOXY". The use of both types of adhesives for installing road markers is known in the art.

The apparatus of the invention is designed to permit installation of road markers without stopping the forward movement of the trailer V. To facilitate this procedure, the glue tube dispenser D may be movable relative to the trailer V at the same speed as the trailer V but in the opposite direction. The effect of such relative movement is to maintain the dispenser D stationary relative to the pavement on which the road markers are being installed while the adhesive is being dispensed.

The apparatus shown in FIG. 1 includes two alternative means for delivering road markers to the installation head H. The first of such means is a carrousel C, shown in generic form in FIG. 1. The carrousel C delivers road markers to the head H via a feed tube 2. The second is a collated unit that feeds road markers on a collation tape from a feed roll F down a guide G to the head H. These two means of delivering markers may be used together, as shown in FIGS. 1 and 2, or may be provided separately in particular applications of the invention.

Whatever delivery means is employed, the system of the invention is designed for fully automated installation of road markers. The invention makes it possible for two workers to simultaneously lay markers on both sides of a traffic lane at a rate of about five miles per hour. One worker drives the vehicle on which the apparatus of the invention is mounted. The other worker monitors the operation, visually and/or through a video monitor, and provides any command input that may be required, such as a command to begin laying the markers in a particular predefined pattern. Both workers preferably remain in the cab of the vehicle during the laying operation. The execution of the laying operation is computer controlled, with various steps in the operation being triggered by sensors that detect movement of portions of the apparatus and/or the presence or absence of objects. The sensors signal the computer, which then signals the parts of the apparatus to activate or deactivate, as appropriate. At present, the major constraint on the speed of operation is the state of the art of adhesives and adhesive application.

Figure 2:
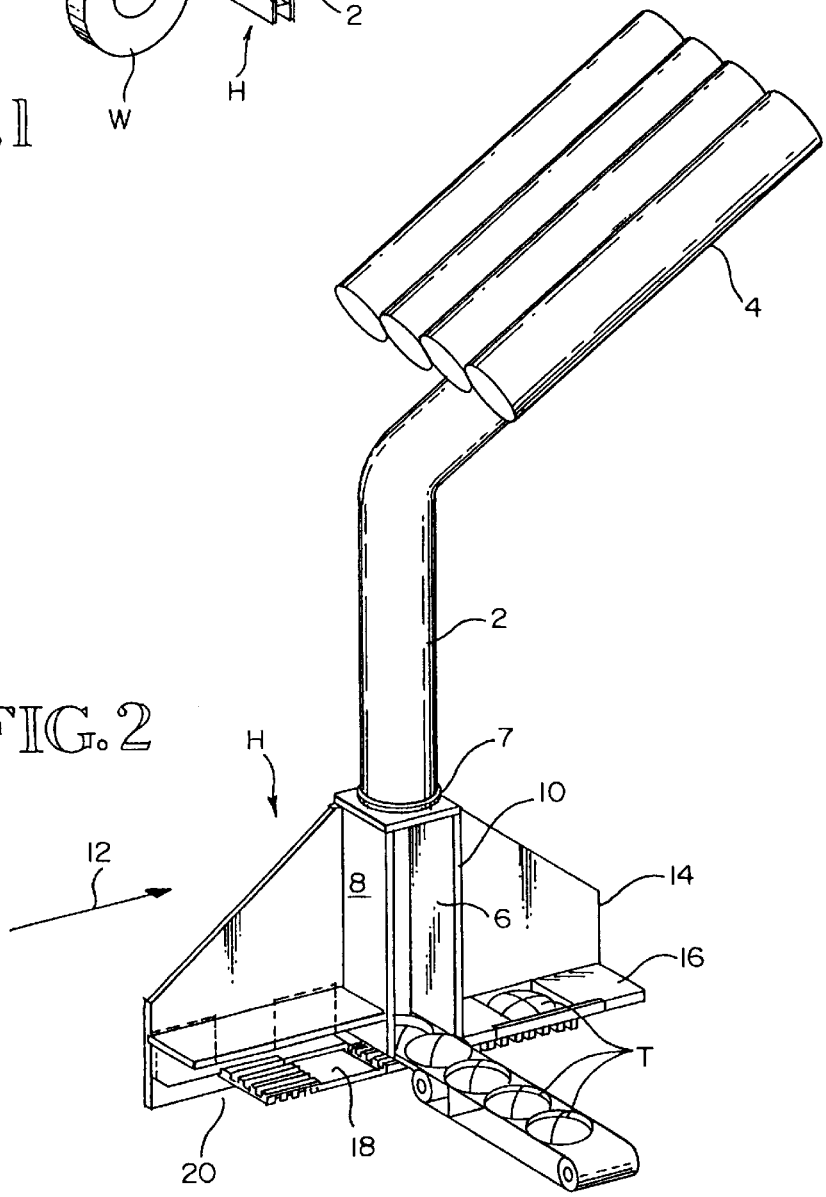
FIG. 2 is a pictorial view of the installation head portion of the apparatus shown in FIG. 1 with foreground portions omitted and upper angled feed tubes added.

FIG. 2 shows the installation head H in more detail. The head H may be used in connection with an entirely vertical feed tube 2, as shown in FIG. 1, or with a modified feed tube having an upper angled section 4, as shown in FIG. 2. The angled section 4 allows the head H to be laterally offset from the trailer bed. Whatever the configuration of the feed tube, road markers are fed downwardly through the vertical tube 2 into a vertical loading chamber 6. The markers may be of various types, such as the round markers T shown in FIG. 2. The markers T are commonly known as "turtles". The chamber 6 is defined by a laterally outer (relative to trailer V) wall 8, a laterally inner wall 10 and opposite laterally extending sidewalls 14. A fitting is provided at the top of the chamber 6 to receive the lower end of the feed tube 2. The fitting 7 shown in FIG. 2 is circular to receive a cylindrical feed tube for round markers T. A square fitting for a square feed tube could also be provided. Such a tube can accommodate either round or square markers.

In accordance with the invention, the installation head has one or more setting stations and preferably has two setting stations. In FIG. 2, the foreground sidewall is omitted to show the portions of the installation head H positioned between the sidewalls 14. The laterally inward direction is indicated in FIG. 2 by the arrow 12. The markers T are moved laterally inwardly and outwardly within the head H by a slide 16 and ultimately to one of two setting stations 18, 20, from which they are set down upon the pavement, as described further below.

Figure 3:
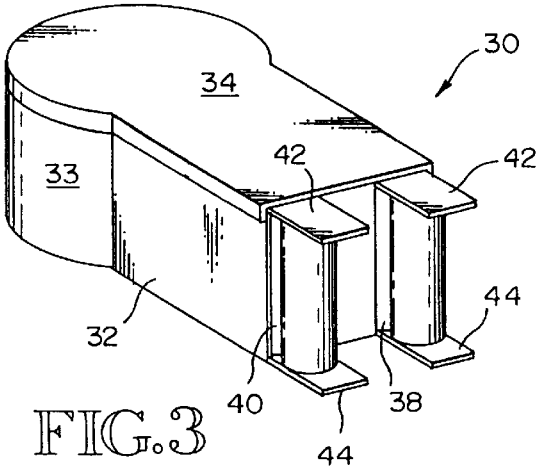
FIG. 3 is a pictorial view of a first preferred embodiment of the carrousel.
Figure 4:
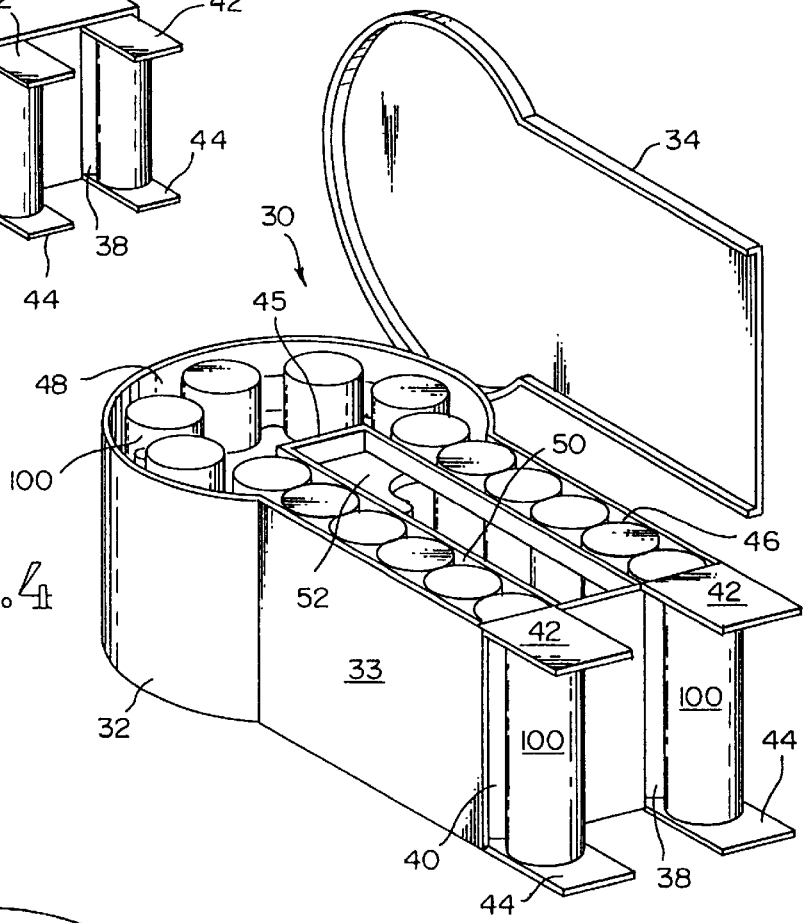
FIG. 4 is a pictorial view of the carrousel shown in FIG. 3 with the cover raised into an open position.
Figure 5:
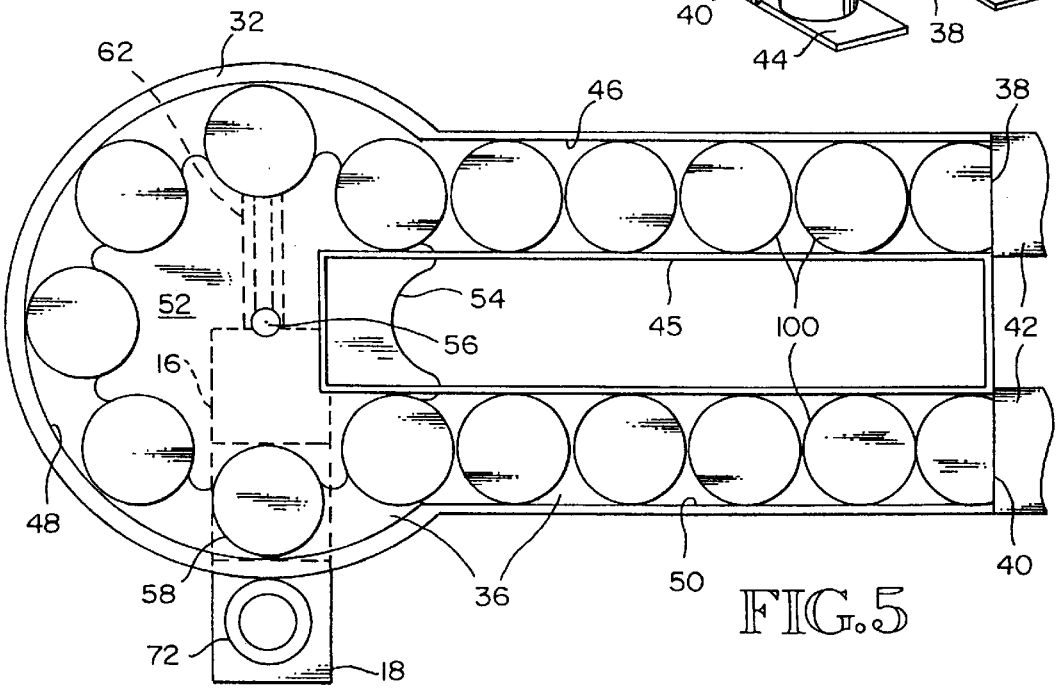
FIG. 5 is a top plan view of the carrousel shown in FIGS. 3 and 4 without its cover and with portions of the installation head apparatus added.

FIGS. 3–5 show a first embodiment of the carrousel 30. The carrousel 30 has a housing 32 with a keyhole-shaped sidewall 33, a removable cover 34, and a floor 36. The narrow end of the sidewall 33 has an entry opening 38 and an exit opening 40. An upper shield 42 and a lower shield 44 extend outwardly from each of these openings 38, 34. A U-shaped inner wall 45 defines, together with the outer sidewall 33, a pathway through the carrousel 30 for bottomless containers 100. As can be seen in FIG. 4, the inner wall 45 has a short vertical dimension and extends downwardly from an upper edge that is substantially flush with the upper edge of the outer sidewall 33. Preferably, a corresponding lower U-shaped wall (not shown) is provided adjacent to the floor 36 of the carrousel 30. The upper and lower U-shaped walls guide the containers 100 as they move through the carrousel C and prevent the containers from deviating from the pathway or tilting. The pathway includes an entry passageway or supply pathway 46 leading from the entry opening 38, an arcuate portion 48, and an exit passageway 50 parallel to the entry passageway 46 and leading to the exit opening 40.

The containers 100 may be moved into the carrousel 30 by various means. One appropriate means is a conveyor that delivers the containers 100 to the entry opening 38. Once the containers 100 have been delivered onto the lower guide 44 and into the entry passageway 46, the containers 100 being delivered behind them push them through the entry passageway 46 toward the arcuate portion 48 of the carrousel pathway. An alternative means for moving the containers 100 is to provide spring biasing at the end of a line of containers 100 which biases the containers 100 toward, into, and through the entry passageway 46.

As the container 100 reaches the end of the entry passageway 46 and the beginning of the arcuate portion 48, it is engaged by an engagement wheel 52. The wheel 52 has a plurality of arcuate cutouts 54 around its circumference. Each cutout 54 is configured to engage a portion of the outer circumferential surface of a container 100. The wheel 52 is mounted on a shaft 56. The shaft 56 is powered to turn intermittently in a counterclockwise direction (as shown in FIG. 5) and thereby rotate the engagement wheel 52 about a vertical axis. This moves the containers 100 in steps from the entry passageway 46 to the exit passageway 50.

The floor 36 of the carrousel 30 is continuous along the pathway 46, 48, 50 except for an opening at a supply station 58. At the supply station 58, there is a vertical opening through the floor 36 to permit markers to drop from the container 100 that is in alignment with the station 58, out of the carrousel 30 and into the feed tube 2. When all the markers from a particular container 100 have been dispensed into the feed tube 2, the engagement wheel 52 is rotated one increment of 45° to bring the next container 100 into position for the markers therein to be dispensed. For automatic operation of the apparatus, a means of detecting when a container 100 is empty is desirable. This may be done, for example, by providing a vertical slot at the bottom of the container 100 and using an optical detector to detect when there are no longer any markers adjacent to the slot.

Figure 6:
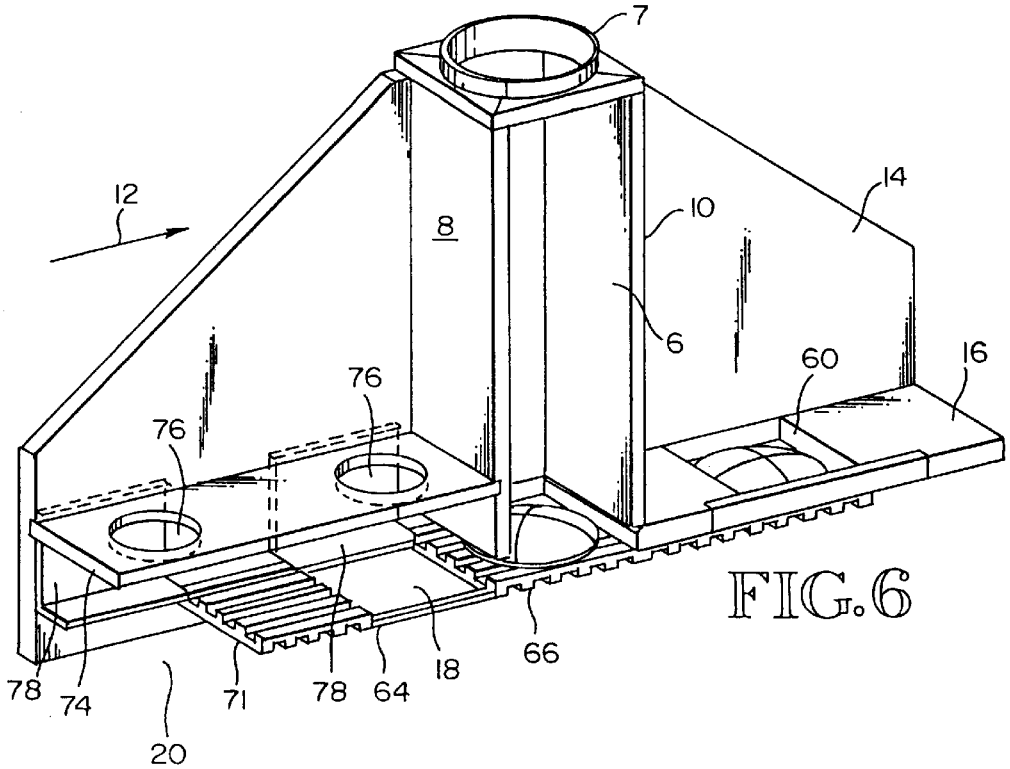
FIG. 6 is an enlarged pictorial view of the installation head shown in FIG. 2.
Figure 7:
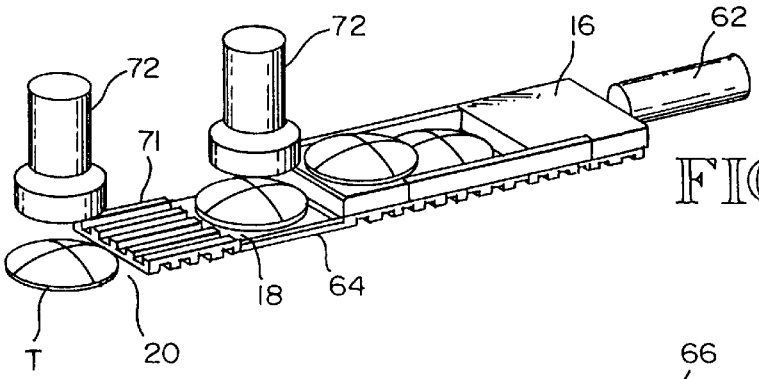
FIG. 7 is a pictorial of the installation head floor and slide shown in FIG. 6, illustrating the setting rams and slide rams schematically.
Figure 12:
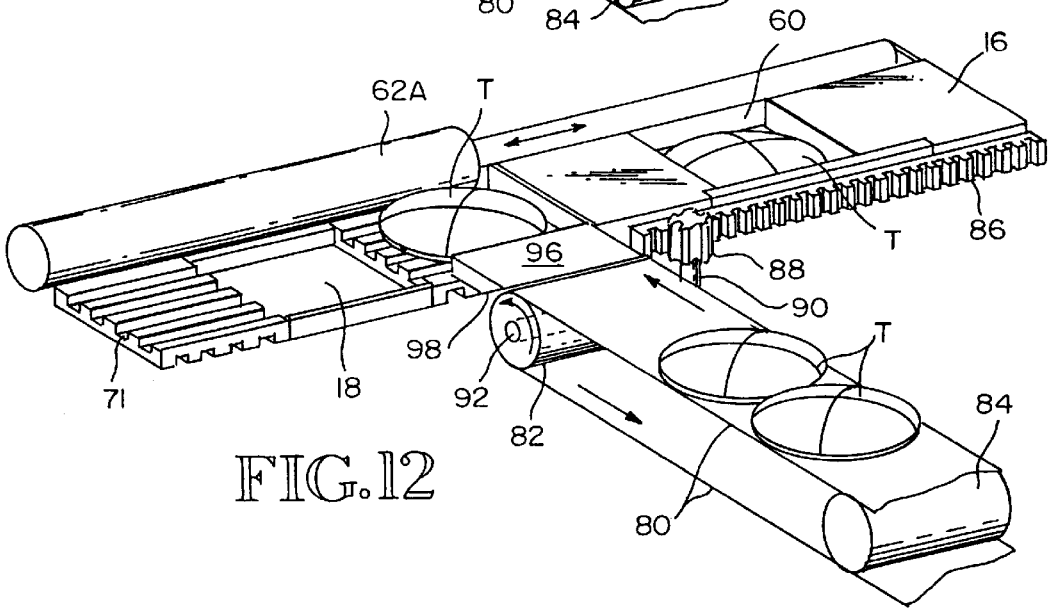
FIG. 12 is a pictorial view of the guide portion shown in FIG. 11, the corresponding floor and slide portions of the installation head, and a parallel-mounted slide ram.

FIGS. 6–9 show the turtle installation head H in greater detail. In FIG. 6, as in FIG. 2, the foreground sidewall 14 is omitted to reveal inner portions of the head H. Referring to FIG. 6, the head H has two loading stations. The first loading station is defined by the loading chamber walls 8, 10, 14 and is located at the bottom of the loading chamber 6. The second loading station 60 is defined by a vertical opening in the slide 16. The slide 16 is slidably mounted on a horizontal installation head floor 64. Thus, the location of the second loading station 60 is movable. The slide 16 is preferably moved horizontally back and forth along the upper surface of the floor 64 by a ram. FIGS. 5 and 7 show a first embodiment of the ram 62 positioned endwise of the floor 64 to engage the laterally inner end of the floor. FIG. 12 shows another embodiment of the ram 62A that is positioned adjacent to and extends parallel to the rear sidewall 14 of the head H. Other means could also be used to move the slide 16, such as a vertical ram and a bell crank. The bottoms of the loading chamber walls 8, 10 are spaced above the floor 64 a distance slightly greater than the height of the markers to allow markers to move along the floor 64, one at a time, under the walls 8, 10, into and out from the loading station at the bottom of the loading chamber 6. The height (vertical thickness) of the slide 16 is substantially equal to the height of the markers to allow the slide 16 to slide under the walls 8, 10.

Figure 8:
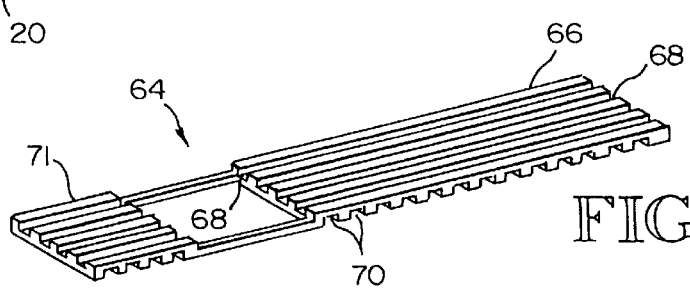
FIG. 8 is a pictorial view of the preferred embodiment of the floor shown in FIGS. 6 and 7.
Figure 9:
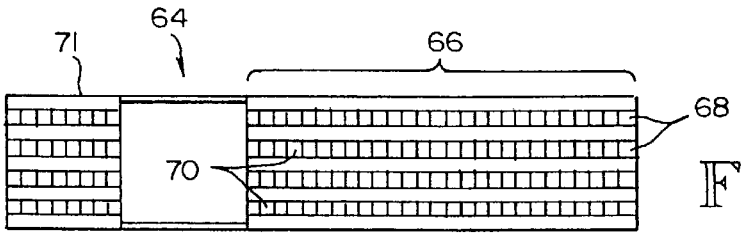
FIG. 9 is a plan view of the floor shown in FIG. 8.

FIGS. 8 and 9 show the details of the structure of the floor 64. The floor 64 has a main slotted portion 66 with intersecting longitudinal slots 68 and cross slots 70. The slots 68, 70 provide holes through the slotted portion 66 at their intersections. This helps to prevent accumulation of debris on the floor 64 to thereby maintain smooth sliding engagement between the slide 16 and the floor 64. The floor 64 also includes a square portion 71 separated from the slotted portion 66 by a vertical opening that defines the first setting station 18. The square portion 71 preferably has the same slotted configuration as the main portion 66.

A setting ram 72, shown in FIG. 7, is provided at each of the setting stations 18, 20. Referring to FIG. 6, a horizontal mounting wall 74 extends from the outer end of the installation head H to the outer wall 8 of the loading chamber 6, between the sidewalls 14 and above the floor 64. An opening 76 extends vertically through the. mounting wall 74 above each of the setting stations 18, 20. The openings 76 are sized to permit the corresponding rams 72 to move downwardly and upwardly through the wall 74 during a setting procedure. Each ram 72 has a housing (not shown in FIG. 7) that is secured to the wall 74. At each setting station 18, 20 there is also provided a pair of opposite bomb bay doors 78. In FIG. 6, the door mounted on the omitted foreground sidewall is not shown. The doors 78 are also omitted in FIG. 11. The manner in which the doors 78 function is described further below. A stop, such as the end wall 79 shown in FIG. 11, is preferably provided to limit lateral movement of a marker entering setting station 20 and maintain the marker in alignment with the ram 72.

Figure 10:
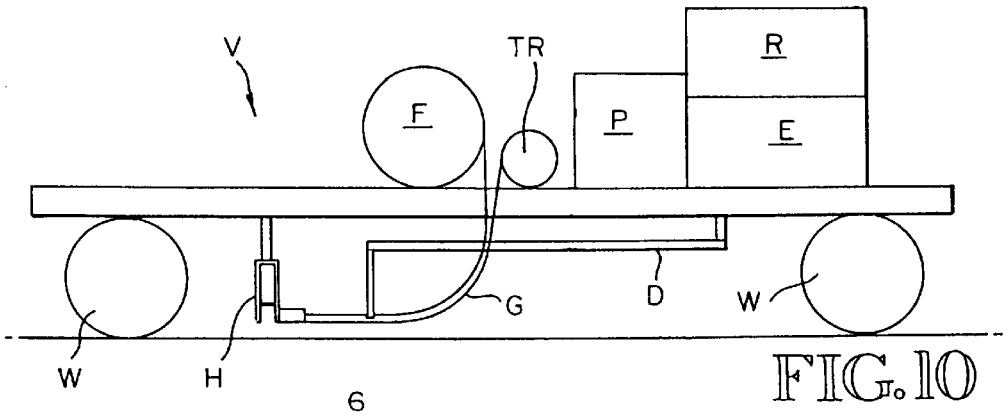
FIG. 10 is a schematic elevational view of a trailer portion of a vehicle similar to that shown in FIG. 1 but omitting the carrousel delivery means.
Figure 11:
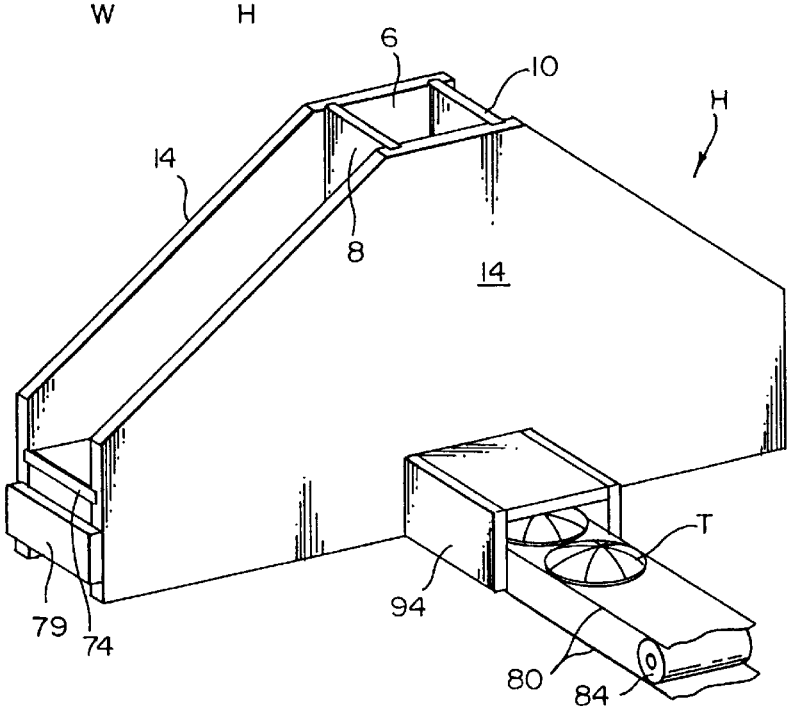
FIG. 11 is a pictorial view of the installation head shown in FIG. 10, including portions of the collation tape guide G.

FIGS. 10–12 further illustrate the alternate means for delivering road markers to the installation head H, i.e. the collated unit. As noted above, the unit feeds road markers on a collation tape or carrier web 80 from a feed roll F mounted on the vehicle bed down a guide G to the installation head H. The outwardly facing surface of the web 80 has a pressure sensitive adhesive thereon for releasably holding a plurality of road markers, such as the turtles T shown in FIGS. 11 and 12. The web 80 has an upper run that extends downwardly from the feed roll F and to the head H, and a lower run that extends back from the head H to a take-up roll TR mounted forwardly of the feed roll F. At the lower end of the carrier run, the web 80 is guided around a drive roller 82 that also causes the web 80 to move incrementally to deliver turtles T to the head H. The guide G includes a plurality of guide rollers 84 positioned at intervals between the drive roller 82 and the upper end of the guide G. The guide G preferably has a housing 94, a portion of which is shown in FIG. 11, that encloses both the upper run and lower run of the web 80 to prevent contamination.

A mechanism is preferably provided for causing operation of the slide ram to operate the drive roller 82 as well as the slide 16. Regardless of the configuration and relative positioning of the ram 62, 62A, it preferably engages the slide 16 to move the slide 16 laterally inwardly and outwardly (relative to the trailer V) along the floor 64. The movement of the slide 16 in turn causes movement of the carrier web 80. For this purpose, a rack 86 is mounted along the side of the slide 16 adjacent to the drive roller 82. The rack 86 engages a pinion gear 88 mounted on a pinion shaft 90. The pinion shaft 90 engages a center roller shaft 92 via a gear box (not shown) to turn the roller 82 and thereby move the web 80. The take-up roll TR is powered, such as by a clutch air driven motor, to provide constant tension on the web 80 and prevent slack.

The turtles T or other markers are delivered from the web 80 into the installation head H. FIG. 11 shows the portion of the guide housing 94 that protects the drive roller 82 and the portions of the head H adjacent to the opening in the sidewall 14 through which the turtles T are delivered. Referring to FIG. 12, as a turtle T reaches the lower end of the upper run of the web 80, it is delivered onto a loading platform 96. The platform 96 has a beveled edge 98 to assist in peeling the turtle T off the web 80. The turtle T moves onto the platform 96 and is pushed by the turtle T behind it into the loading station at the bottom of the loading chamber 6. The gear ratios of the drive mechanism 86, 88, 90, 92 of the drive roller 82 are chosen so that one increment of slide movement causes delivery of one marker T from the web 80 to the bottom of the loading chamber 6. One increment of slide movement is one-third the length of the slide 16 or one-fifth the length of the floor 64.

Road markers that are delivered to the bottom of the loading chamber 6 down through the feed tube 2 or rearwardly from the collation web 80 are moved laterally within the head H by the slide 16. As noted above, the markers are moved laterally to the setting stations 18, 20 from which they are set down onto the pavement by the setting rams 72. When a marker is delivered to one of the setting stations 18, 20, it is maintained at a vertical level flush with the top of the floor 64 by the bomb bay doors 78. The bomb bay doors 78 support the marker until the setting ram 72 is activated to force the marker down through the bomb bay doors 78 and onto the pavement.

FIGS. 13–17 show the preferred configuration of the bomb bay doors 78 and illustrate the function of the doors 78. Each setting station 18, 20 is provided with a pair of bomb bay doors 78 mounted on the opposite sidewalls 14 of the head H. Each door 78 has an L-shaped configuration with a generally vertical leg 102, a generally horizontal leg 104, and a cylindrical end portion 106 at the free end of the horizontal leg 104. The upper free end of the vertical leg 102 is connected to a hinge 108 that is mounted on the outer face of the respective sidewall 14 by means of a hinge plate 110. A biasing spring 112 is mounted on a post 114 that has an inner end secured to the sidewall 14, extends outwardly through a hole in the vertical leg 102, and terminates in an outer abutment 116 formed by an end cap. The opposite ends of the spring 112 abut against the outer abutment 116 and the vertical leg 102, respectively. The horizontal leg 104 extends from the bottom edge of the vertical leg 102 through an opening 118 in the sidewall 14. The spring 112 biases the door 78 into the position shown in FIGS. 13 and 15.

When both doors 78 at the station 18, 20 are in the position shown-in FIGS. 13 and 15, the upper surfaces of the cylindrical end portions 106 are flush with the top of the floor 64 and support a marker T in the station 18, 20, as shown in FIG. 13. Since the tops of the door portions 106 and the floor 64 are flush, the marker T may either be moved from the first station 18 to the square portion 71 of the floor 64 by the slide 16 or set down onto the pavement at station 18 by the setting ram 72. A marker at the second station 20 has reached the limit of its travel and is set down onto the pavement. At each station 18, 20, when the setting ram 72 is activated, it exerts a downward force on the marker T that pushes the marker T downwardly and forces the horizontal legs 104 of the bomb bay doors 78 outwardly, as illustrated in FIGS. 14 and 16. Once the marker T has cleared the bomb bay doors 78, the springs 112 return the doors 78 to their rest position shown in FIGS. 13 and 15. The doors 78 are then ready to support the next marker that is moved into the station 18, 20 by the slide 16.

FIGS. 18–21 show a modified form of the slide 16' and a ram head 146 for use with round markers T. The slide 16' cooperates with a stop member 79' to hold a marker T in position in alignment with the ram 72 at a setting station 18, 20. The engagement of the marker T prevents the marker T from wobbling. Referring to FIGS. 18–20, the slide 16' has an extension 120 that terminates in a vertical arcuate end surface 122. On each side of the extension 120, there is a vertical sidewall 124 and a horizontal projection 126 at the bottom of the sidewall 124. The sidewalls 124 and projections 126 extend from the end surface 122 along about half the length of the slide 16'. The stop member 79' is a horizontally orientated U-shaped member having an opening 130 extending vertically through and along the member 79' from an inner arcuate end to an outer open end at one end 132 of the member 79'. The opening 130 has a lower portion 134 with a vertical sidewall, a beveled portion 136 with a radially inwardly sloping sidewall, and an upper portion 138 with a vertical sidewall. The opening 130 is dimensioned to receive the extension 120 of the slide 16' with the projections 126 on the slide 16' being received in the lower portion 134 of the opening 130, as shown in FIGS. 19 and 20.

FIG. 18 shows the slide 16' in a position in which it is retracted away from the stop member 79' and the arcuate surface 122 confronts the end 132 of the stop member 79'. When the slide 16' is moved toward the member 79', a marker T is engaged by the arcuate surface 122 and is pushed by the slide 16' into the opening 130 in the member 79'. The extension 120 of the slide 16' moves with the marker T into the opening 130 and into the position shown in FIGS. 19 and 20. In this position, the arcuate surface 122 is urged against the marker T to firmly position the marker T with its lower edge in the lower portion 134 of the opening 130. The beveled surface 136 engages the rounded sloping upper surface of the marker T. The engagement of the marker T by the arcuate surface 122 and opening sidewalls 134, 136 holds the marker T in a horizontal position aligned with the setting ram 72 to prevent wobbling or tilting of the marker T. The radius of curvature of the arcuate surface 122 may be slightly small (about ¼ inch) than the radius of curvature of the marker T to ensure firm contact at the two opposite ends of the surface 122. When the marker T has been engaged, the ram 72 may be operated to set the marker T down onto the pavement.

As shown, the slide 16' is configured for use in an installation head having a single setting station. The slide 16' could be modified to include a second loading station, such as the second station 60 shown in FIGS. 6, 7, 12, and 26–29. If this were done, appropriate adjustments in the dimensions of the slide 16' and of the installation head floor would need to be made.

FIGS. 20 and 21 illustrate a ram head 146 designed for use with round turtle markers T. As shown in FIG. 20, the ram 72 has a cylinder housing 140 secured to the mounting wall 74 by a nut 144. A piston rod 142 slidably extends out through the lower end of the cylinder housing 140 through the corresponding opening 76 in the mounting wall 74. The ram head 146 is attached to the outer end of the piston rod 142 by a nut 148. The head 146 has a generally cylindrical or disk-like configuration with a downwardly facing recess 152, 154. The inner portion 152 of the recess has a cylindrical sidewall. The outer portion 154 of the recess has a beveled sidewall that tapers radially outwardly and downwardly from the bottom edge of the inner portion sidewall. The beveling of the outer recess portion 154 is configured to engage the rounded upper surface of a turtle T. When the ram 72 is activated, the piston rod 142 moves downwardly to move the head 146 downwardly against the turtle T engaged in the stop member 79' by the slide 16'. The force of the head 146 against the turtle T forces the turtle T downwardly and the bomb bay doors 78 outwardly to allow downward passage of the turtle T. The ram 72 forces the turtle T down onto a pool of adhesive dispensed from the glue tube D with sufficient force to set the turtle T into the adhesive. The diameter of the head 146 is chosen to permit the head 146 to move between the bomb bay doors 78 even when the doors 78 are in their closed position shown in FIGS. 13 and 15.

The ram head 146 shown in FIGS. 20 and 21 is suitable for use with the type of round domed markers known as turtles T. For other types of road markers, other ram head configurations are needed. One such other type of marker is illustrated in FIGS. 22, 23, and 25. This marker RM has a square base with four inwardly and upwardly sloping side surfaces and a flat top. There are two major side surfaces and two smaller minor side surfaces 158. Commonly, one of the major side surfaces is provided with a reflector 156.

A ram head 160 suitable for use with the square reflective marker RM is shown in FIGS. 24 and 25. This ram head 160 has a rectangular configuration with a downwardly opening slot 162, 164 extending laterally therethrough. The inner portion 162 of the slot has vertical sidewalls and the outer portion 164 has beveled sidewalls sloping downwardly and outwardly from the bottom of the inner portion 162. A cylindrical recess 166 is provided in the downwardly facing wall of the slot 162,164 for receiving a nut to mount the ram head 160 on a piston rod. The beveled portion 164 of the slot is configured to engage the sloping major side surfaces of a reflective marker RM, as illustrated in FIG. 25.

FIGS. 26–29 illustrate the operation of the installation head slide 16 for moving road markers into position to be set down onto the pavement by the setting rams. As shown in FIGS. 26–29, square road markers RM are being fed into the installation head down through the loading chamber 6. For purposes of illustration, the sidewalls of the installation head are omitted and the walls 8, 10, of the loading chamber 6 are shown with a shortened vertical height. A stack of markers RM are shown in the loading chamber 6. In actual operation, it is preferable to maintain the loading chamber 6 full with a stack of road markers. The weight of the road markers helps to maintain the markers at the bottom of the stack properly oriented and to prevent tilting of the markers. Since a stack of markers is preferably maintained in the loading chamber 6, there is no need for a gate between the loading chamber 6 and a carrousel or other apparatus from which markers are received into the loading chamber 6. However, a gate could be provided to drop markers one at a time down into the loading chamber 6 without departing from the spirit and scope of the invention.

Figure 26:
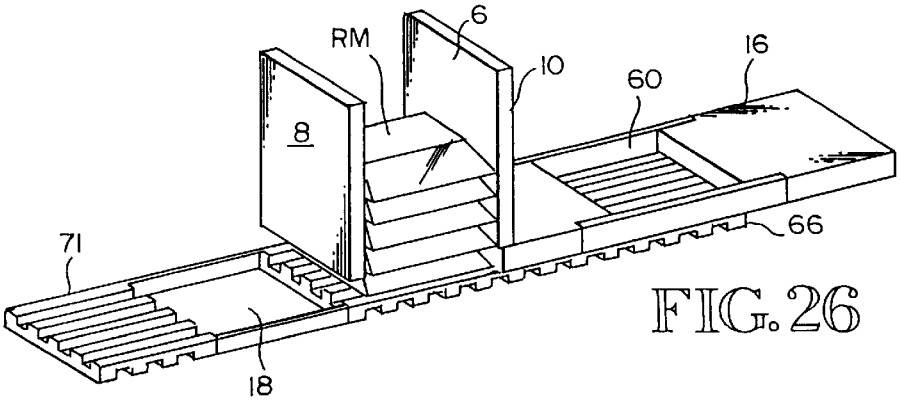
FIGS. 26–29 are pictorial views of the installation head floor and slide and portions of the loading chamber walls, illustrating operation of the slide to move markers into position to be set down onto pavement.

FIG. 26 illustrates the beginning of an operation in which road markers RM in the loading chamber 6 are moved into position for setting down onto pavement. In FIG. 26, the slide 16 is in its fully retracted position, i.e. in its extreme rightward (as shown) position. The slide 16 is moved back and forth along the floor of the installation head in increments, with each increment substantially equaling the distance between the two loading chambers walls 8, 10. This distance is also the width of the loading station 60, the solid slide portions on either side of the station 60, floor portion 71, and setting stations 18, 20.

Figure 27:
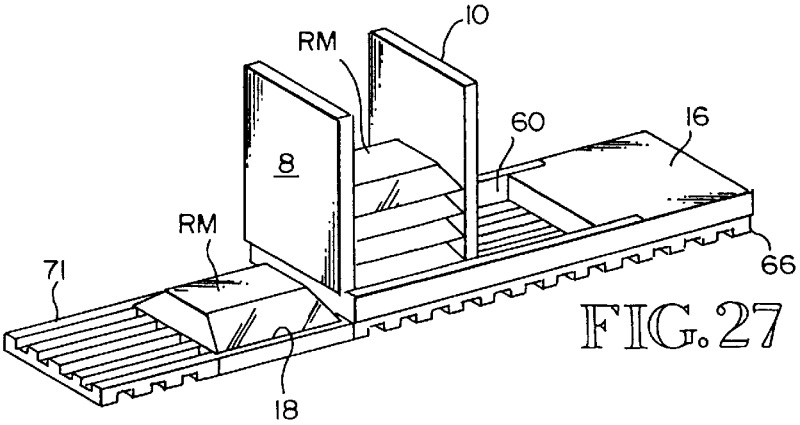

FIG. 27 shows the slide 16 after it has been moved one increment to the left. The movement of the slide 16 has caused the left end of the slide 16 to push the lowermost marker RM in the loading chamber 6 out from the loading chamber 6 and the first loading station and into setting station 18. At setting station 18, the marker RM is supported by the bomb bay doors (not shown in FIGS. 26–29). The second loading station 60 has moved to a position adjacent to the loading chamber but still does not have a marker positioned therein.

Figure 28:
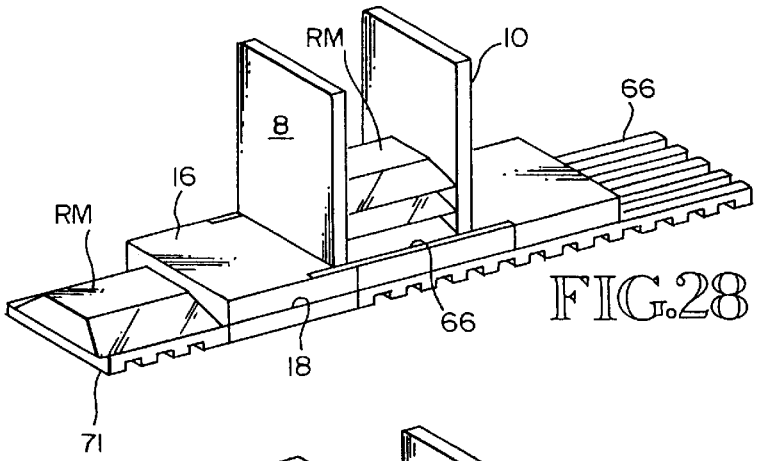
Figure 29:
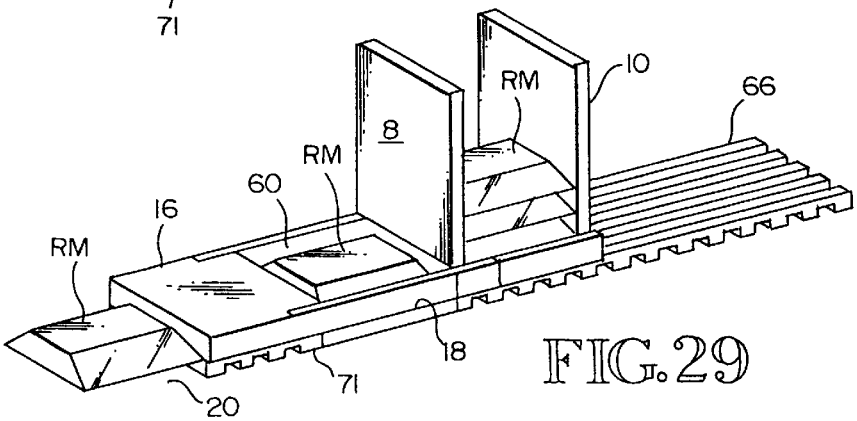

In FIG. 28, the slide 16 has been moved an additional increment from the position shown in FIG. 27. This movement has caused the marker RM at setting station 18 to be moved out of setting station 18 by the end of the slide 16 and onto the square portion 71 of the floor. The second loading station 60 has been moved into the loading chamber 6. In this position, the two loading stations of the installation head coincide. No further markers RM have been moved out of the loading chamber 6 by the second increment of movement of the slide 16 since such movement was blocked by the chamber wall 8. When the loading station 60 moves into registry with the loading chamber, a second marker RM drops down into the loading station 60. This allows the second marker RM to move out of the loading chamber 6 when the slide 16 is moved a further increment to the left into the position shown in FIG. 29. As shown in FIG. 29, the second marker RM has been carried by the slide 16 out of the loading chamber 6 and into setting station 18. At this point in the operation of the slide 16, the second loading station 60 coincides with the setting station 18. Movement of the slide 16 has also moved the first marker RM from the floor portion 71 into the second setting station 20.

At the stage of operation shown in FIG. 29, markers RM are positioned to be set down onto the pavement from one or both of the setting stations 18, 20. After the desired marker or markers RM have been set down, the slide 16 is retracted back into the position shown in FIG. 26. The apparatus then has the configuration shown in FIG. 26 except that there is a new marker RM in the second loading station 60. When the marker RM shown in setting station 18 in FIG. 29 has been set down onto the pavement, the new marker RM drops down into the second loading station 60 when the slide 16 returns to the position shown in FIG. 28 and then is moved out of the loading chamber 6 by the slide 16. If the marker RM at station 18 has not been set down, it is simply carried back by the slide 16 through the loading chamber 6 and then to the right of the loading chamber 6.

When the cycle is again initiated to move markers into the setting stations 18, 20, the presence of a marker RM in the loading station 60 at the beginning of the cycle has no effect on the operation other than to prevent the movement of an additional marker RM into loading station 60 and out from the loading chamber 6 when the slide 16 moves from the position shown in FIG. 27 to the position shown in FIG. 29. The movement of a marker RM through the loading chamber 6 either to the left or to the right is allowed since the space between the bottom of the loading chamber walls 8, 10 and the floor is substantially equal to the vertical thickness of the slide 16 and of the markers RM. As a marker RM slides through the loading chamber 6, it simply serves as a support for the markers RM already positioned in the loading chamber 6, in the same manner that the solid portions of the slide 16 serve as such a support.

The operation of the installation head slide 16 when the markers are being fed into the installation head H from a collation tape or carrier web 80 is much the same as the operation described above, in which markers are fed down into the loading chamber 6. Referring to FIGS. 12 and 26–29, the initial movement of the slide causes a marker T to be fed from the web 80 into the loading chamber 6 and onto the leftward (as shown) solid portion of the slide 16. At this point, the operation must be varied from that described above. The slide 16 is retracted back to its initial position shown in FIG. 26 and then is again advanced to the position shown in FIG. 27. This moves the marker T out from the loading chamber 6 and into setting station 18. Subsequent steps of the operation are the same as previously described. The additional steps are necessary since movement of the carrier web 80, and thus delivery of the markers T into the loading chamber 6, are tied to movement of the slide 16 actuated by the slide ram 62, 62A. The manner in which each increment of movement of the slide 16 causes delivery of a marker T to the loading chamber 6 is described above in connection with FIG. 12.

If movement of the web 80 is activated only during the first two increments of movement of the slide 16, i.e. only when the slide moves from the position of FIG. 26 to the position of FIG. 27 and then to the position of FIG. 28, the two initial additional steps must be repeated for every cycle of operation of the slide 16 to prime the installation head with a marker T positioned laterally outwardly of the laterally outward end of the slide 16. The need for.the two additional initial steps after the first cycle of slide movement can be eliminated by causing the third increment of movement of the slide 16, the movement from the position shown in FIG. 28 to the position shown in FIG. 29, to also activate movement of the web 80. This causes an additional marker T to be moved into the loading chamber 6 so that there are two markers T in the loading chamber 6 when the slide 16 is retracted from the FIG. 29 position to the FIG. 26 position. One of the two markers T drops down into the second loading station 60 as the slide 16 is being retracted. The other remains in the loading chamber 6 as the slide 16 moves into the FIG. 26 position so that it is adjacent to the laterally outer end of the slide 16 ready to be moved into setting station 18 when the new cycle is commenced. Another alternative would be to eliminate the initial one increment back and forth movement of the slide 16 by providing instead an additional retracted position of the slide 16 one increment to the right of the position shown in FIG. 26. This alternative could be used in combination with the three-step activation of web 80 by the slide 16 described above. Other variations of the procedure are also possible.

Referring back to FIGS. 26–29, the cycle of operation described in connection therewith may be followed repeatedly as long as, at the end of each cycle, both markers in setting stations 18,20, or only the marker in the second setting station 20, are set down onto the pavement by the setting rams. If the marker in setting station 18 is not set down, it remains in loading station 60 and is carried back by the slide 16 when the slide 16 retracts. However, if the marker in the second setting station 20 is not set down, it is not carried back by the slide 16 and remains in setting station 20. If the cycle shown in FIGS. 26–29 is repeated, a second marker will be moved toward and into the already occupied setting station 20. Although the movement of the second marker may push the first marker in the station 20 against the bomb bay doors 78 to open the doors 78 and therefore discard the first marker, it is preferable not to rely upon this occurrence. In order to maximize the reliability of the apparatus and minimize the chances of jamming the apparatus, it is desirable to prevent a second marker from moving into the setting station 20.

Figure 30:
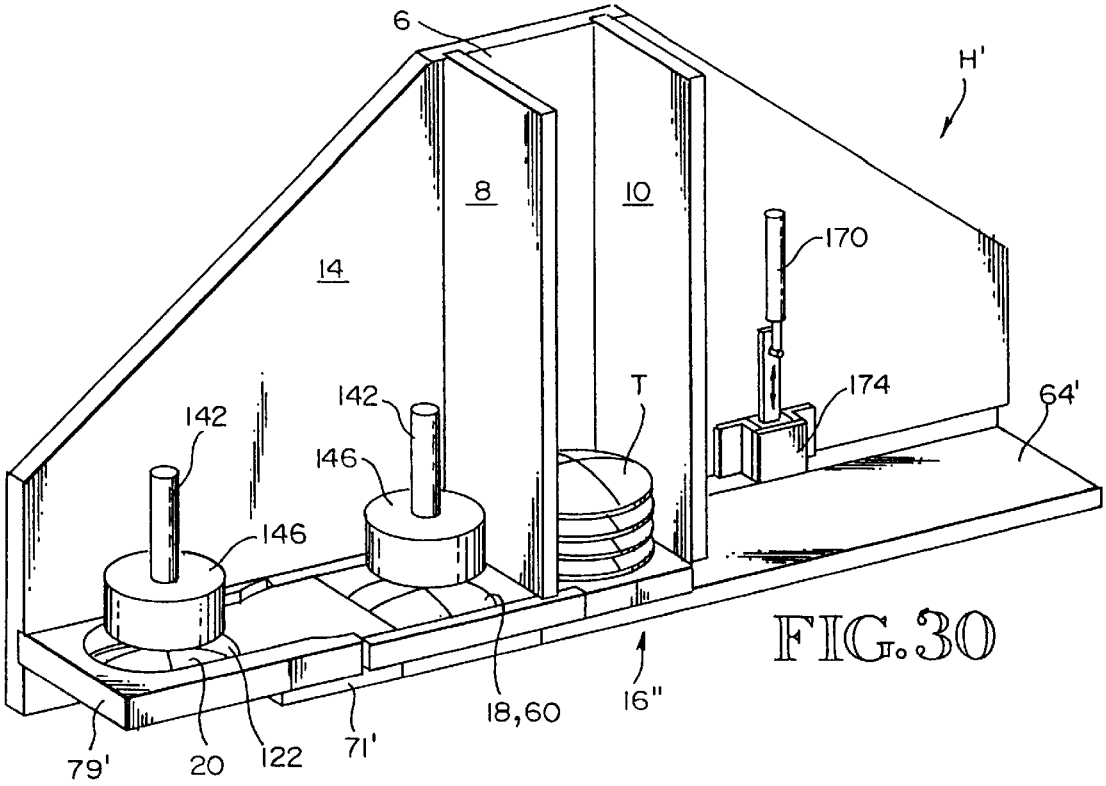
FIG. 30 is a pictorial view similar to FIG. 6 illustrating a modified form of the installation head having a stop dog.
Figure 31:
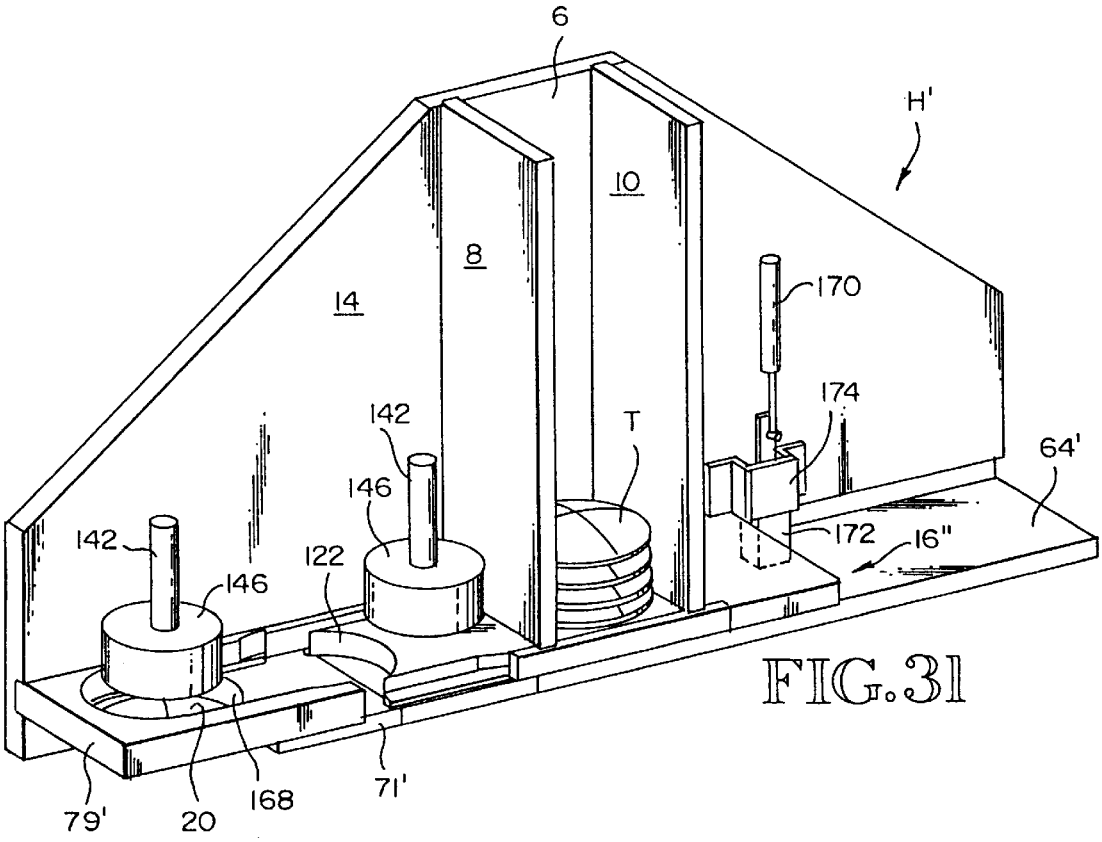
FIG. 31 is like FIG. 30 except that is shows the installation head slide in a different position and the stop dog actuated to limit movement of the slide.

FIGS. 30 and 31 illustrate a modified form of the installation head H' that includes a mechanism for limiting the retraction of the slide following a cycle in which the marker in setting station 20 is not set down onto the pavement. The installation HI shown in FIGS. 30 and 31 has a structure similar to that shown in FIG. 6. The head H' has opposite sidewalls 14 and a loading chamber 6 defined by the sidewalls 14 and end walls 8,10. The floor 64' is shown without the longitudinal and cross slots 68, 70 of the floor 64 shown in FIG. 6, but such slots 68,70 may advantageously be added. Another difference in the floor 64' shown in FIGS. 30 and 31 is preferable for the installation of round markers T. This is the configuration of the end portion 71' of the floor 64'. Rather than being a square, such as a square floor portion 71 shown in FIG. 6, the end portion 71' of FIGS. 30 and 31 has an arcuate outer end surface 168 that, together with stop member 79', defines setting station 20. The slide 16" of head H' has a configuration similar to the slide 16' shown in FIGS. 18–20. The main difference is that slide 16" is longer than the slide 16' and, like the slide 16 shown in FIG. 6, defines a second loading station 60. When the slide 16" moves into its extended position shown in FIG. 30, the arcuate end surface 122 of the slide 16" aligns with the arcuate end surface 168 of the floor 64' to insure proper positioning of the marker T in setting station 20. The head H' may also be provided with a floor and end stop member configured for use with square reflective markers RM.

The operation of the head H' is illustrated in FIGS. 30 and 31. FIG. 30 shows the slide 16" in its fully extended position and markers T in place in each of setting stations 18,20 ready to be set down onto the pavement by the setting rams. As noted above, if the setting operation includes the setting down of the marker T in setting station 20, the complete cycle of retraction and extension of the slide is then repeated. If the marker T in station 20 is not set down, a sensor (not shown) detects that the setting ram at setting station 20 has not been activated and signals the operating system. The signal results in a command that activates a ram 170 mounted on one of the sidewalls 14 of the head H'. A stop dog 172 is carried by the outer end of the piston rod of the ram 170. In FIG. 30, the dog 172 is not visible in its retracted position inside dog guide and housing 174. When ram 170 is activated, the piston rod extends to move the dog 172 downwardly toward the floor 64' and into the path of the retracting slide 16". This limits the retraction of the slide 16" to the position shown in FIG. 31. When the slide movement to the left (as shown) is recommenced, a marker T moves from the loading chamber 6 into setting station 18. However, there is no marker T to the left of the slide 16", and thus movement of a second marker T into setting station 20 is prevented. Upon activation of the setting ram at setting station 20, the sensor signals the operating system and the ram 170 is retracted to retract the stop dog 172. Thereafter, the full cycle of operation is carried out.

Figure 32:
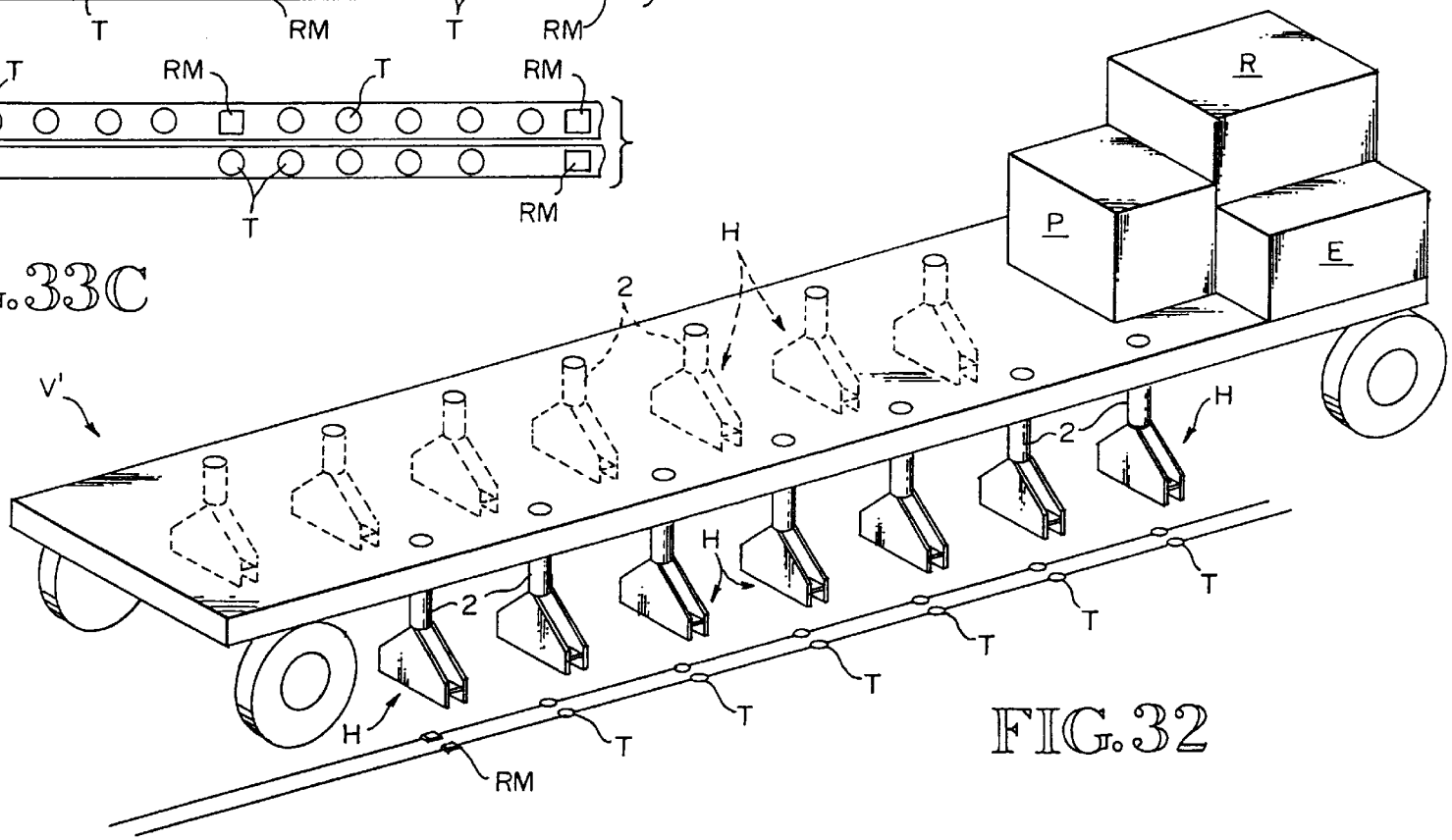
FIG. 32 is a pictorial view of a vehicle trailer equipped with a plurality of installation heads.

For the purposes of facilitating the description of the invention, FIGS. 1 and 10 show installation apparatus with a single installation head H. Although such apparatus is consistent with the scope of the invention, the efficiency of the operation of the apparatus of the invention may by greatly increased by providing a plurality of installation heads on a single vehicle trailer. FIG. 32 illustrates what is anticipated as being a typical configuration of installation heads H for use in installing road markers T, RM in the construction of new roadways. Referring the FIG. 32, there are seven installation heads H mounted on each side of a vehicle trailer V'. Each of the heads H extends laterally outwardly from the trailer V'. The width of the trailer V' and the amount by which the heads H extend laterally are chosen so that the lane markers on both sides of a lane may be set down with a single pass of the trailer V'. The trailer V' is equipped with the type of apparatus shown in FIG. 1 and described above, including an electrical unit E, an adhesive reservoir R, and an air compressor P. For the purpose of simplifying the illustration of the installation head configuration, no apparatus is shown for feeding markers into the heads H. Markers may be fed into the heads H by means of various devices, such as the carrousel 30 shown in FIGS. 3–5 and described above, the carrier web 80 shown in FIGS. 11 and 12, or the devices described below. If desired, different types of devices and/or different types of markers may be provided for different installation heads H on the same trailer V'.

In the operation of the apparatus shown in FIG. 32, correct positioning of the lines of markers may be facilitated by triangulation using sending units forward and to the side of the vehicle and a monitor in the vehicle. Accurate positioning and spacing of individual markers can be accomplished by use of a timing wheel that contacts the pavement. The computer monitors the rotations per minute of the wheel to determine distance traveled and thereby determine where to place the markers. Once a marker has been laid down on the pavement, its resistance to movement can be tested to determine if it is properly set down into the adhesive so that, upon curing of the adhesive, it will be firmly bonded to the pavement. For this purpose, a downwardly depending arm carried by a switch may be positioned rearwardly of the installation head to contact the marker. If the resistance of the marker is sufficient, it will trigger the switch to signal the computer that the marker has been properly laid. If the marker yields, the arm will tend to push it aside and the absence of a signal will alert the computer to the failure of the laying down procedure.

Figure 33A:
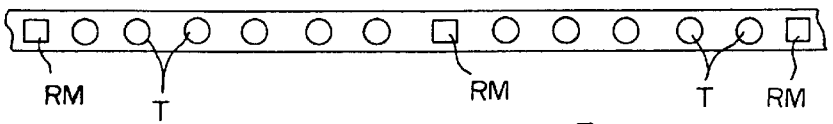
FIGS. 33A, 33B, and 33C are schematic views illustrating three typical patterns in which road markers are laid.
Figure 33B:
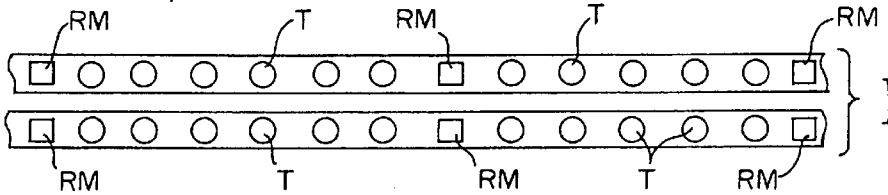
Figure 33C:
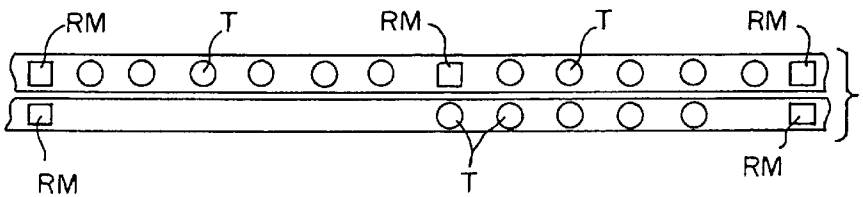

FIGS. 33A, 33B, and 33C illustrate three typical patterns of lane markers used in highway construction. In FIG. 33A, there is a single line of markers consisting mostly of round markers T with reflective markers RM interspersed at predetermined intervals. The configuration shown in FIG. 33B comprises a double line of markers, each of which has the same configuration as the single line shown in FIG. 33A. The configuration shown in FIG. 33C has two lines of markers with one line being the same as that shown in FIGS. 33A and 33B and the other line also including both round markers T and reflective markers RM but having blank spaces in the line. The three configurations shown in 33A–33C have been chosen to illustrate typical marker patterns used in current road construction. The apparatus of the invention makes it possible to efficiently lay any one of the illustrated configurations as well as a wide range of other configurations that may be required. FIG. 32 illustrates the use of the foreground installation heads H to lay the pattern shown in FIG. 33B.

The system of the invention may be operated using conventional road markers T, RM as long as the markers T, RM are manufactured within reasonable dimensional tolerances. However, for optimal efficiency and reliability, it is desirable that the system of the invention employ modified markers such as those illustrated in FIGS. 34–38. Referring to FIGS. 34, 35A, and 35B, a modified turtle-type marker TI has the same basic shape as conventional turtle T shown in FIG. 7. The only significant difference is the presence of indexing portions of the modified turtle TI. Referring to FIGS. 34 and 35A, the center portion of the rounded upper surface of the marker TI includes a cross-shaped projection 176. The projection 176 has four arms that are equal in length and equally circumferentially spaced. The center of the cross coincidences with the center of the upper surface of the marker TI. The flat lower surface of the marker TI is shown in FIG. 35B. It includes a depression 178 complementary to the upper raised portion 176 for receiving the raised portion 176 of an adjacent marker TI. The depression 178 includes an outer annular portion 180 and eight radially extending and equally circumferentially spaced spokes 182 extending from the center to the outer annular portion 180. The depression 178 generally conforms to the curvature of the upper surface of the marker TI to receive the upper surface and accommodate the raised portion 176 in the depression 178. Since the depression 178 has eight spokes 182, when a second marker TI is dropped down onto a first marker TI, each of the arms of the raised portion 176 will readily be received into one of the depression spokes 182 with any small additional movement of the upper marker TI. Such additional movement is a natural occurrence in most stacking operations.

When the indexed markers TI are used in a feed tube or other apparatus in which the markers are stacked, the interlocking of the raised portions 176 and depressions 178 prevents the markers TI from tilting in the tube. The avoidance of tilting of the markers TI prevents jamming of the markers TI in the tube and incorrect orientation of the markers TI when they reach the loading station at the bottom of the tube. The interlocking of the indexing portions 176, 178 does not interfere with the movement of a marker TI out of a loading station at the bottom of a loading chamber 6 since the curvature of the upper surface of the marker TI allows the bottom marker TI to slide easily out from under the stack of markers TI.

It is anticipated that, in most applications, only a single type of marker will be used in any particular feed tube. However, if it is desired, round and square markers may be mixed in a single feed tube or other feeding apparatus. For this purpose, the square markers to be used in such a system preferably have on their lower surfaces a depression 178 of the type shown in FIG. 35B. Complementary projections 176 on the flat upper surfaces of the square markers may also be provided. This would prevent rotation of the round markers in a mixed stack.

FIGS. 36A and 36B show another form of the indexed marker TI-2. Like the marker TI shown in FIGS. 34, 35A, and 35B, the marker TI-2 has a projection and a recess configured to allow adjacent markers to interlock in a plurality of relative circumferential orientations. The projection comprises four equally circumferentially spaced raised dimples 175 arranged in a circle concentric with the upper surface of the marker TI-2. The recess comprises eight equally circumferentially spaced circular depressions 177, two depressions 177 for each dimple 175. The circular area 179 defined by the depressions 177 forms a central depression 179 to accommodate the curved upper surface of the marker TI-2.

FIGS. 37 and 38 illustrate additional modifications to be used with specialized markers. Referring to FIG. 37, a square marker RM' has two opposite reflective surfaces 156 and two solar cells 184 on its flat upper surface. The solar cells 184 can be used for powering a flasher implanted in the marker RM' or a transmitter for transmitting a signal from the marker RM'. Such a transmitter might be used, for example, to transmit traffic flow information to a central location. Another use would be to transmit accident location information once the marker transmitter is triggered by a law enforcement official. One of the solar cells 184 may be replaced by a receiver for receiving a signal from a law enforcement official to begin flashing or transmitting. FIG. 38 illustrates a modified round indexed marker TI'. This marker TI' has the same outer configuration shown in FIGS. 34-35B and the additional feature of an internal cavity 186. This internal cavity 186 provides a place for a microchip embedded in the marker to control transmitting and/or recording functions. A similar cavity would be provided in a square marker having such functions. With the development of sensor and information systems technology, it is anticipated that a wide range of additional uses for the solar cell and microchip features of the specialized markers will be developed.

FIGS. 39 and 40 show another modified marker T' that may be used in an automated marker installation system. The marker T' has an indexing slot 188 opening onto its bottom surface. The marker T' may be fed down to an installation head through a feed tube having a lower horizontal run 190. The feeding of the markers T' down to the point shown in FIG. 39 may be accomplished under the action of gravity and/or the action of the markers pushing each other along. A conveyor 192 is positioned at the end of the lower run 190. When a marker T' reaches the conveyor 192, an indexing pin 194 carried by the conveyor 192 is received into the indexing slot 188 in the bottom of the marker TI. A spring loaded upper member 196 is provided above the conveyor 192 to push down on the upper surface of the marker T, and maintain the pin 194 in the slot 188. The conveyor 192 moves the marker T' into the installation head in the manner described above in connection with FIG. 12. In order to maintain the markers in correct rotational orientation for engagement by the indexing pins 194, a thin web of material may be provided connecting a line of markers T' together. The conveyor 192 preferably has plurality of indexing pins 194 for engaging a plurality of markers T'.

FIGS. 41–45 illustrate another form of carrousel that may be used to feed road markers to installation heads in accordance with the invention. Referring to FIG. 41, the carrousel 198 has three concentric tiers, including a rotatable upper tier 200, a stationary middle tier 202, and a rotatable lower tier 204. The upper and lower tiers 200, 204 are rotatable relative to the stationary middle tier 202. The upper tier 200 has a plurality of openings for receiving road markers. These openings are arranged in a plurality of concentric circles, with an inner circle of round openings 206 surrounded by a middle circle of square openings 208 and an outer circle of round openings 206. These openings are arranged to align with elongated vertical openings in the middle and lower tiers 202, 204, which accommodate stacks of markers. The round openings are designed to receive round markers T, and the square openings are designed to receive square reflective markers RM. The number of openings in the carrousel may be varied. The currently preferred arrangement of openings is shown in FIG. 42. This arrangement has four concentric circles of openings with three inner circles in the pattern shown in FIG. 41 and an additional outer circle of square openings 208.

The upper tier 200, 200' is of minimal thickness to receive a single marker in each opening 206, 208. The function of the upper tier 200, 200' is to receive markers one at a time from feed guides to 210, 212. The upper tier 200, 200' is rotated continuously to continuously fill any opening 206, 208 that is empty. In turn, the upper tier 200, 200' continuously refills any empty space in the corresponding elongated openings in the middle tier 202. The lower tier 204 is rotated in increments as necessary to receive markers from the middle tier 202 and position a complete stack of markers above an appropriate feed tube. The feed tubes may be angled and arranged to feed a plurality of installation heads.

Referring to FIG. 42, the feed guideways 210, 212 are enclosed pathways with a height just sufficient to allow the passage of a single line of markers therethrough. Each of the guideways 210, 212 is fed from a conventional sorter (not shown) which feeds markers into the guideway 210, 212 one at a time. The limited height of the guideway 210, 212 prevents vertical overlapping of the markers in the guideway 210, 212. In most circumstances, the rotational orientation of the round markers is of no consequence. Therefore, the round markers are fed through guideways 210 directly to the round openings 206. In FIG. 42, there is a guideway 210 for round markers for each of the two concentric circles of round openings 206. There are also two guideways 212 for square markers RM.

Referring to FIG. 43, each of the guideways 212 for square markers RM includes a cover 214 and an orienting station 216. The purpose of the orienting station 216 is to ensure that the reflective surface 156 of each square marker RM that is fed into the upper tier 200' from the guideway 212 is in the correct orientation for its installation on the pavement. To control entry of markers RM into the orienting station 216, a pair of gates 218 are provided upstream of the station 216 to inhibit movement of markers RM toward and into the station 216 until the station has been vacated by the previous marker RM.

An additional gate (not shown) may be provided at the downstream end of the station 216 to limit movement of the marker RM entering the station 216. The lowering of such a gate to permit exiting of the oriented marker RM may also be used to trigger a sensor to signal the upstream gates 218 to lower to allow the next marker RM to enter the station 216.

FIG. 44 shows schematically the sensing and orienting mechanisms at the station 216. An optical sensor 220 shines a light on the adjacent face of the marker RM in the station 216 and detects light reflected back from the reflective surface 156. If the reflective surface 156 is not in the correct position adjacent to the sensor 220, a pivot shaft 222 is raised into engagement with the marker RM. The upper radial surface of the shaft 222 has a pattern of projections 224 complementary to the depression pattern shown in FIG. 36. The underside of marker RM has a depression with the configuration shown in FIG. 36. Thus, the projection 224 on top of the shaft 222 interlocks with the bottom of the marker RM. A spring 226 carried by the cover 214 of the guideway 212 presses down on the top of the marker RM to ensure its proper engagement with the pivot shaft 222. The shaft 222 pivots to pivot the marker RM until the sensor 220 detects the correct orientation of the reflective surface 156. After the marker RM has been oriented, it moves on through the guideway 212 and is deposited in the upper tier 200' of the carrousel. The two separate guideways 212 may be used for feeding markers RM with opposite orientations into the carrousel, as illustrated in FIG. 45. This enables the simultaneous installation of markers from a single carrousel onto lines on opposite sides of a single traffic lane, in the manner illustrated in FIG. 32.

FIG. 46 shows another device for feeding markers to an installation head in accordance with the invention. In this device, a row of bottomless rectangular containers 230 are fed along a supply pathway or guide path 232 to a corner supply station having a vertical opening through which the markers are fed down into an installation head. The containers 230 may be moved along the guide path 232 by a conveying mechanism or by a spring mechanism that urges the containers 230 toward the supply station. In either case, a stop (not shown) is preferably provided to prevent the containers 230 from moving beyond the supply station. The containers 230 may accommodate round or square markers. In the latter case, the packaging of the markers in rectangular containers in preformed stacks serves to automatically orient the reflective surfaces in the proper direction. An optical sensor 234 is provided adjacent to the supply station to detect through a side opening or sensing aperture at the bottom of the container 230 when the container 230 has been emptied of markers. When this condition is detected, a ram 236 is activated to move the empty container 230 out of the supply station 58 in a direction perpendicular to the guide path 232. The ram 236 has an engagement plate 238 that engages a projection (not shown) on the container 230. The opposite sidewall of each container 230 is preferably provided with a recess for accommodating the projection on an adjacent container 230.

FIG. 47 illustrates a modified form of the bomb bay door 78' and the mechanism for biasing the door 78' into its closed position. The bomb bay door 78 shown in FIG. 47 has a vertical leg 102 pivotably attached to an installation head sidewall by hinge 108, and a horizontal leg 104 terminating in a cylindrical end portion 106. In this respect, the door 78' has the same structure as that shown in FIGS. 13–17. The modification of the door 78' includes a horizontal projection 240 projecting outwardly from the vertical leg 102. A pivot attachment 242 is provided at the outer end of the projection 240 to pivotably attach the outer end of the piston rod 244 of a hydraulic shock absorber 246 to the projection 240. The shock absorber 246 is mounted on the installation head sidewall and resists outward opening movement of the bomb bay door 78' in the same manner that the spring shown in FIGS. 15 and 16 resists outward movement. The shock absorber 246 also provides constant pressure to bias the door 78' back into its closed position when the force holding it open has been removed. One advantage of using a shock absorber to provide the desired biasing is the durability and reliability of shock absorbers.

The above discussion of the operation of the system of the invention has focused on the installation of markers in new road construction. The system of the invention may also be used advantageously in repair operations to replace broken or missing markers on an existing roadway. In such an operation, a vehicle, such as the trailer V shown in FIG. 1, is moved along the roadway adjacent to the line of markers. The trailer V preferably has a plurality of installation heads for laying different types of markers. A sensor at the front end of the vehicle detects the occurrence of missing or broken markers. When a missing marker is detected, the operator determines what type of marker is required and activates the system to install a replacement marker. When a broken marker is detected, the broken marker must first be removed before a new marker can be installed.

FIG. 48 illustrates apparatus carried by a front portion of the vehicle for removal of damaged markers. The apparatus includes a scraper 250 and a vacuum tube 252 with a flared lower end 254. The scraper 250 has a pointed forward end that is urged under the adhesive body 256 holding the damaged marker T to separate the adhesive 256 from the pavement and free the marker T. The scraper 250 is preferably part of a vibrating device similar to an electric jack hammer to facilitate the breaking of the adhesive bond. The freed marker T and removed adhesive and other associated debris are sucked up into the vacuum tube 252 into a waste container. Then, the vehicle is moved into position to install a new marker to replace the damaged one. The flared lower end 254 of the vacuum unit is sufficiently flexible to allow the unit to move over additional road markers in its path. The scraper 250 must be retracted between removal procedures.

Figure 49:
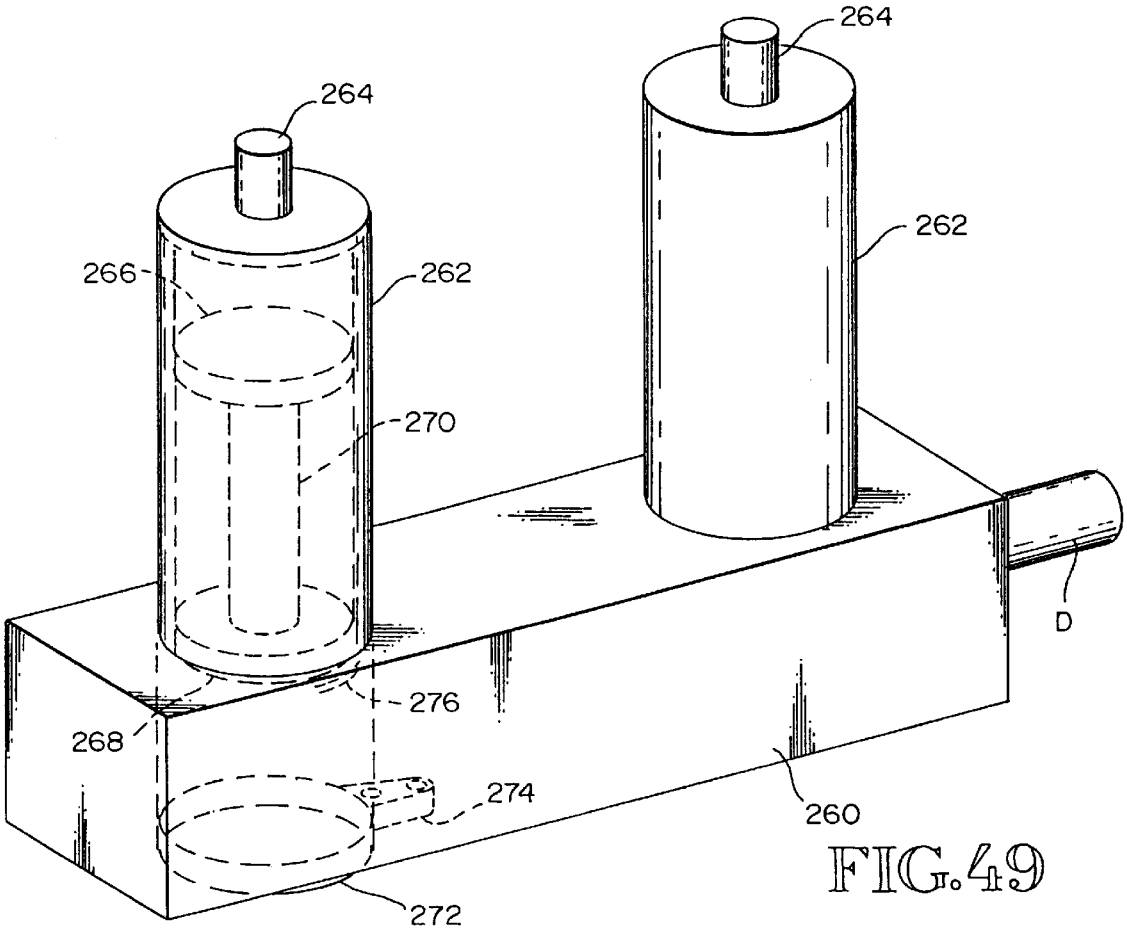
FIG. 49 is a pictorial view of a glue dispensing manifold.

FIG. 49 shows a glue dispensing manifold 260 designed for use with the double installation head illustrated and described above. Glue dispensers currently in use have a single nozzle and are not adequate for simultaneous dispensing of glue for placement of two side-by-side markers. They also are not designed for dispensing glue in either one of two side-by-side locations. Referring to FIG. 49, the manifold 260 has a pair of spaced apart air ram cylinders 262 mounted thereon. The cylinders 262 are spaced apart the same distance that the setting stations 18, 20 in the installation head are spaced apart and that road markers are typically spaced apart in a double centerline installation. Each cylinder 262 has an air inlet 264 for receiving a coupling to receive compressed air from the compressor P. A double-headed piston member is slidably positioned inside the cylinder 262. The piston member has an upper air ram actuator piston 266 and a lower ejection piston 268 spaced apart from the actuator piston 266 by a rod 270. A lower nozzle is formed by an opening in the bottom wall of the manifold 260 under each of the cylinders 262. Each nozzle has a nozzle port cover 272 with a projecting arm 274. A second smaller air activated cylinder (not shown) is attached to the arm 274 to open and close the nozzle port by pivoting the cover 272 horizontally along the bottom of the manifold 260.

Heated bituminous adhesive is supplied into the manifold 260 through the glue tube D. Electrical heating tape or a hot oil jacket are provided around the manifold body to maintain the temperature of the adhesive therein and reheat the adhesive, as needed. The interior of the manifold 260 is filled with adhesive. The portions of the manifold interior inside the lower portions of the cylinders 262 are filled through openings in such lower portions. The openings in each cylinder 262 are preferably in the form of two circumferential grooves 276 in the cylinder wall just below the position of the ejection piston 268 shown in FIG. 49. The grooves 276 and the axial thickness of the piston 268 are dimensioned so that the piston 268 covers the grooves 276 when it moves downwardly from the FIG. 49 position. The grooves 276 remain blocked by the piston 268 until the piston 268 returns to the FIG. 49 position.

In operation, the manifold 260 is brought into position above the location where glue is to be dispensed by movement of the vehicle. When the manifold 260 is in position, the control system signals valves to open to deliver pressurized air to one or both of the cylinders 262. The pressurized air enters inlet 264 and acts on actuator piston 266 to move the piston member downwardly. The ejection piston 268 acts on the body of glue in the manifold 260 to eject glue out through the nozzle. At the same time, the smaller air cylinder pivots the nozzle cover 272 the appropriate amount to allow the desired amount of glue to be released through the nozzle down onto the pavement. The pivotal mounting of the cover 272 is an over-center arrangement to provide quick snap action opening and closing of the cover 272 and thereby assure dispensing of the correct amount of glue. The use of the manifold makes it possible to have sufficient glue in position over the deposit location to deposit two bodies of glue simultaneously, if required. It also allows the selected deposit of glue in only one of two side-by-side locations, if that is required. After the glue at a particular location has been deposited, the manifold is refilled through the glue tube D so that there is a full supply at hand when the next location is reached.

Figure 50:
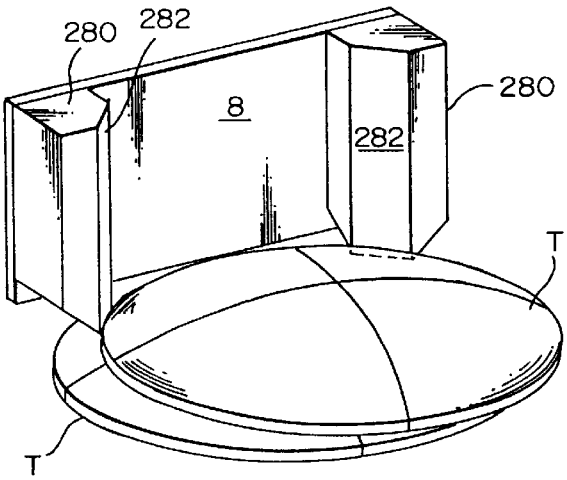
FIG. 50 is a pictorial view of blocking members that may be used in the loading chamber.

FIG. 50 illustrates a preferred feature that helps prevent jamming of the installation head when conventional round markers T are being installed. Referring to FIG. 50, the bottom portion of loading chamber wall 8 may be provided with opposite blocking members 280. Each blocking member 280 has a vertical surface secured to the wall 8. The bottom of the member 280 is spaced a small amount above the bottom of the wall 8. The cross section of the member 280 is in the shape of a square with one corner cut off to form a diagonal vertical surface 282. The diagonal surfaces 282 of the two members 280 are oriented at 90° with respect to each other and 45° with respect to the wall 8. As illustrated in FIG. 50, the height and orientation of the surfaces 282 are such that the surfaces 282 engage a marker T and block its movement when another marker T under the first marker T is pushed out of the loading chamber 6 under the wall 8 by the slide 16. The members 280 prevent the upper marker T from traveling along with the lower marker T and jamming the space under the wall 8. The opposite loading chamber wall 10 may also be provided with a pair of blocking members 280.

Although the preferred embodiments of the invention have been illustrated and described herein, it is intended to be understood that various modifications and omissions in form and detail may be made without departing from the spirit and scope of the invention as defined by the following claims.

What is claimed is:

1. Apparatus for installing raised road markers on a roadway, comprising a delivery platform having a supply station and including a floor, a delivery opening extending vertically through the floor at the supply station, and a supply pathway extending along the floor and leading to the supply station, said floor being at least substantially continuous along the supply pathway except for the delivery opening; a plurality of separate bottomless containers configured to be received onto the floor, each container being dimensioned to receive a stack of markers and having a sensing aperture in a lower portion thereof; a sensor positioned adjacent to the supply station to sense through said aperture when a container in the supply station is empty of markers; and a removal actuator engageable with a container in the supply station to move the container out of the supply station and allow another container to move along the floor and the supply pathway into the supply station.

2. The apparatus of claim 1, in which the removal actuator comprises a ram extendible and retractable perpendicularly to the supply pathway to move a container in the supply station out of the supply station in a direction perpendicular to the supply pathway.

3. Apparatus for installing raised road markers on a roadway, comprising a delivery platform having a supply station, a delivery opening extending vertically through the platform at the supply station, and a supply pathway leading to the supply station; a plurality of bottomless containers, each dimensioned to receive a stack of markers and having a sensing aperture in a lower portion thereof; a sensor positioned adjacent to the supply station to sense through said aperture when a container in the supply station is empty of markers; and a removal actuator engageable with a container in the supply station to move the container out of the supply station and allow another container to move along the supply pathway into the supply station;

in which the removal actuator comprises an engagement wheel powered to rotate about a vertical axis and having a plurality of circumferentially spaced cutouts configured to engage circumferential surfaces of said containers.

4. Apparatus for installing raised road markers on a roadway, comprising a delivery platform having a supply station, a delivery opening extending vertically through the platform at the supply station, and a supply pathway leading to the supply station; a plurality of bottomless containers, each dimensioned to receive a stack of markers and having a sensing aperture in a lower portion thereof; a sensor positioned adjacent to the supply station to sense through said aperture when a container in the supply station is empty of markers; and a removal actuator engageable with a container in the supply station to move the container out of the supply station and allow another container to move along the supply pathway into the supply station;

in which said containers are rectangular, and the removal actuator comprises a ram extendible and retractable perpendicularly to the supply pathway to pull a container in the supply station out of the supply station in a direction perpendicular to the supply pathway.

5. Apparatus for installing raised road markers on a roadway, comprising a carrousel that has three concentric tiers each having a plurality of vertical openings to receive markers; said tiers including a rotatable top tier having a height substantially equal to the height of a single marker, a stationary middle tier, and a rotatable lower tier, each of said middle and lower tiers having a height sufficient to accommodate a stack of markers in each said vertical opening therein, and said vertical openings in each tier being alignable with said vertical openings in an adjacent tier.

6. Apparatus for installing raised road markers on a roadway, comprising a delivery platform having a supply station and including a floor, a delivery opening extending vertically through the floor at the supply station, and a supply pathway extending along the floor and leading to the supply station, said floor being at least substantially continuous along the supply pathway except for the delivery opening; a plurality of separate bottomless containers configured to be received onto the floor, each container being dimensioned to receive a stack of markers; and a sensor positioned adjacent to a lower portion of the supply station to sense when a container in the supply station is empty of markers; said supply station having an open exit side to allow a container in the supply station to be moved out of the supply station through said exit side and another container to move along the floor and the supply pathway into the supply station.

7. The apparatus of claim 6, further comprising a removal actuator that is extendible and retractable perpendicularly to the supply pathway to move a container in the supply station out of the supply station in a direction perpendicular to the supply pathway.

* * * * *